US007745085B2

(12) United States Patent
Ishiyama et al.

(10) Patent No.: US 7,745,085 B2
(45) Date of Patent: Jun. 29, 2010

(54) TONER FOR DEVELOPING ELECTROSTATIC LATENT IMAGE AND METHOD OF MANUFACTURING SAME, ELECTROSTATIC LATENT IMAGE DEVELOPER, CARTRIDGE, AND IMAGE FORMING APPARATUS

(75) Inventors: Takao Ishiyama, Minamiashigara (JP); Takashi Inukai, Minamiashigara (JP); Akitsugu Seto, Minamiashigara (JP); Tomohito Nakajima, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 455 days.

(21) Appl. No.: 11/727,495

(22) Filed: Mar. 27, 2007

(65) Prior Publication Data

US 2008/0025754 A1 Jan. 31, 2008

(30) Foreign Application Priority Data

Jul. 28, 2006 (JP) ..... 2006-207031

(51) Int. Cl.
*G03G 9/08* (2006.01)

(52) U.S. Cl. ..... 430/109.4; 430/111.4; 430/137.14; 399/106; 399/252

(58) Field of Classification Search ..... 430/109.4, 430/111.4, 137.14; 399/106, 252
See application file for complete search history.

(56) References Cited

U.S. PATENT DOCUMENTS

| | | | | |
|---|---|---|---|---|
| 3,853,778 | A | 12/1974 | Buckley et al. | |
| 4,264,697 | A | 4/1981 | Perez et al. | |
| 2005/0271965 | A1* | 12/2005 | Kamiyoshi et al. | 430/111.4 |
| 2006/0105258 | A1* | 5/2006 | Ishiyama et al. | 430/108.4 |
| 2007/0092821 | A1* | 4/2007 | Sato et al. | 430/108.4 |
| 2007/0166636 | A1* | 7/2007 | Daimon et al. | 430/109.3 |

FOREIGN PATENT DOCUMENTS

| | | |
|---|---|---|
| JP | A 56-11461 | 2/1981 |
| JP | B2 56-13943 | 4/1981 |
| JP | A 56-83749 | 7/1981 |
| JP | B2 56-13943 | 4/1983 |
| JP | A 62-39879 | 2/1987 |
| JP | B2 62-39428 | 8/1987 |
| JP | B2 63-25335 | 5/1988 |
| JP | A 4-120554 | 4/1992 |
| JP | B2 4-30014 | 5/1992 |
| JP | A 4-239021 | 8/1992 |
| JP | A 5-165252 | 7/1993 |
| JP | A 2001-117268 | 4/2001 |
| JP | A-2002-351139 | 12/2002 |
| JP | A-2004-198598 | 7/2004 |
| JP | A-2004-285131 | 10/2004 |
| JP | A 2005-292683 | 10/2005 |

(Continued)

*Primary Examiner*—John L Goodrow
(74) *Attorney, Agent, or Firm*—Oliff & Berridge, PLC

(57) ABSTRACT

A toner for developing an electrostatic latent image that includes a crystalline polyester resin and a release agent, wherein structures in which the crystalline polyester resin contacts the release agent exist in a ruthenium-stained cross section of the toner, and if the cross-sectional area of these structures is labeled A, the cross-sectional area of lone portions of the release agent is labeled B, and the cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$.

10 Claims, 2 Drawing Sheets

FOREIGN PATENT DOCUMENTS

| | | |
|---|---|---|
| JP | A 2006-084953 | 3/2006 |
| JP | A-2006-145725 | 6/2006 |
| JP | A-2006-195260 | 7/2006 |
| JP | A 2006-259431 | 9/2006 |
| JP | A 2006-276073 | 10/2006 |
| JP | A 2006-292683 | 10/2006 |

* cited by examiner

TONER FOR DEVELOPING ELECTROSTATIC LATENT IMAGE AND METHOD OF MANUFACTURING SAME, ELECTROSTATIC LATENT IMAGE DEVELOPER, CARTRIDGE, AND IMAGE FORMING APPARATUS

CROSS-REFERENCE TO RELATED APPLICATIONS

This application is based on and claims priority under 35 USC 119 from Japanese Patent Application No. 2006-207031, filed on Jul. 28, 2006.

BACKGROUND

1. Technical Field

The present invention relates to a toner for developing an electrostatic latent image and an electrostatic latent image developer that can be used in an electrophotographic apparatus that employs an electrophotographic process, such as a copying machine, printer, or facsimile, and also relates to a method of manufacturing the toner for developing an electrostatic latent image and an image forming apparatus.

2. Related Art

In order to reduce the quantity of energy used by a copying machine or printer, technology that enables fixing to be conducted at lower energy levels is very desirable. Accordingly, there is a strong demand for electrophotographic toners that enable fixing to be conducted at lower temperatures.

Typical techniques for lowering the fixing temperature of a toner involve lowering the glass transition temperature of the toner resin (the binder). As a result of factors such as powder aggregation (blocking) and the storage properties of the toner on the fixed image, the practical lower limit for the glass transition temperature is typically 50° C., and preferably 60° C.

On the other hand, in order to achieve low-temperature fixability, the use within heat-roller fixing of a crystalline polyester resin, where possible without mixing with other components, has also been proposed.

SUMMARY

The present invention includes the aspects described below.

According to an aspect of the invention, there is provided a toner for developing an electrostatic latent image that includes a crystalline polyester resin and a release agent, wherein structures in which the crystalline polyester resin contacts the release agent exist in a ruthenium-stained cross section of the toner, and if the cross-sectional area of these structures is labeled A, the cross-sectional area of lone portions of the release agent is labeled B, and the cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$.

BRIEF DESCRIPTION OF THE DRAWINGS

Exemplary embodiment(s) of the present invention will be described in detail based on the following figures, wherein.

DETAILED DESCRIPTION

Figure 1:
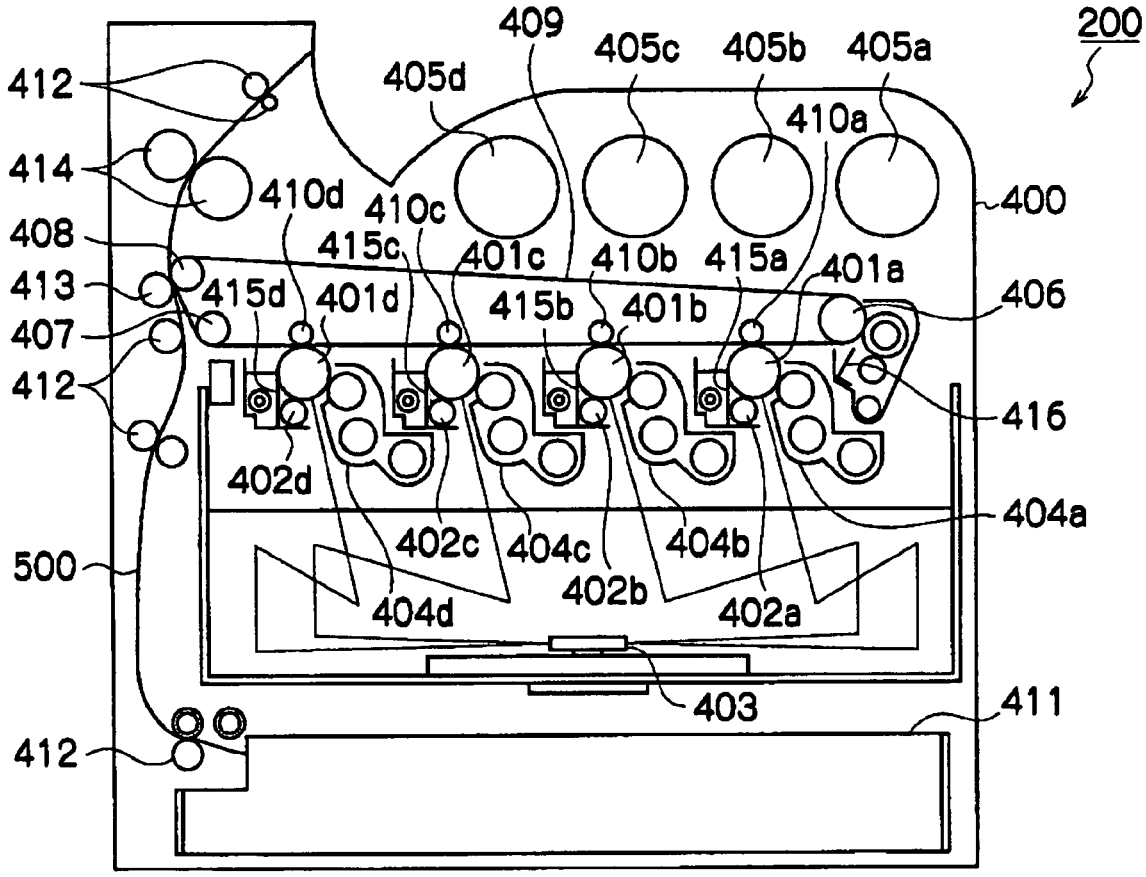
FIG. 1 is a schematic illustration showing a sample configuration of an image forming apparatus according to an exemplary embodiment of the present invention.

As follows is a more detailed description of a toner for developing an electrostatic latent image, a method of manufacturing such a toner, an electrostatic latent image developer, and an image forming apparatus according to the present invention.

[Toner for Developing an Electrostatic Latent Image]

A toner for developing an electrostatic latent image (hereafter also referred to simply as "toner") according to an exemplary embodiment of the present invention includes a crystalline polyester resin and a release agent, wherein structures in which the crystalline polyester resin contacts the release agent exist in a ruthenium-stained cross section of the toner, and if the cross-sectional area of these structures is labeled A, the cross-sectional area of lone portions of the release agent is labeled B, and the cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$. In this description, the term "structure" refers to a structure 100 such as that shown in FIG. 2, wherein the crystalline polyester resin 12 either contacts, or is embedded within, the release agent 10, even at only a single point. The non-crystalline polyester resin described below exists around the periphery of these structures, around the periphery of lone portions of the release agent, and around the periphery of lone portions of the crystalline polyester resin.

Moreover, in a toner for developing an electrostatic latent image according to this exemplary embodiment of the present invention, the acid value for the crystalline polyester resin is within a range from 5 to 10 mgKOH/g, the acid value for the non-crystalline polyester resin is within a range from 10 to 15 mgKOH/g, the melting temperature of the crystalline polyester resin determined in accordance with ASTM D3418-8 is within a range from 65 to 75° C., the weight average molecular weight (Mw) of the crystalline polyester resin is within a range from 10,000 to 25,000, the glass transition temperature (Tg) of the non-crystalline polyester resin determined in accordance with ASTM D3418-8 is within a range from 55 to 65° C., the weight average molecular weight (Mw) of the non-crystalline polyester resin is within a range from 20,000 to 50,000, and the weight ratio between the crystalline polyester resin and the non-crystalline polyester resin is within a range from 5/95 to 40/60.

—Crystalline Polyester Resin—

In this description, the term "crystalline polyester resin" refers to a resin that exhibits a clear endothermic peak rather than a stepwise variation in the quantity of heat absorption when measured using differential scanning calorimetry (DSC). In a toner for developing an electrostatic latent image according to the present invention, the term "crystalline" describes a resin that exhibits a sharp endothermic peak when measured using differential scanning calorimetry (DSC), and more specifically, describes a resin for which the full width at half maximum of the endothermic peak obtained upon measurement at a rate of temperature increase of 10° C./minute is no more than 6° C.

Specifically, aliphatic crystalline polyester resins having a suitable melting temperature and containing alkyl groups of 6 or more carbon atoms are particularly preferred as the crystalline polyester resin. Polyester resins containing alkyl groups of 6 or more carbon atoms can be obtained by using a polymerizable monomer having an alkyl group of 6 or more carbon atoms as either the polyvalent carboxylic acid or polyhydric alcohol described below. One suitable example is dodecenylsuccinic acid, although the present invention is not restricted to this case.

The crystalline polyester resin is obtained mainly through a condensation polymerization of a polyvalent carboxylic acid and a polyhydric alcohol. In the present invention, a copolymer in which another component is introduced into the principal chain of the crystalline polyester resin in a proportion of no more than 50% by mass is also referred to as a crystalline polyester.

Examples of the polyvalent carboxylic acid used in the preparation of the polyester resin used in the exemplary embodiment of the present invention include aromatic dicarboxylic acids such as terephthalic acid, isophthalic acid, orthophthalic acid, 1,5-naphthalenedicarboxylic acid, 2,6-naphthalenedicarboxylic acid and diphenic acid, aromatic oxycarboxylic acids such as p-oxybenzoic acid and p-(hydroxyethoxy)benzoic acid, aliphatic dicarboxylic acids such as succinic acid, alkylsuccinic acids, alkenylsuccinic acids, adipic acid, azelaic acid, sebacic acid and dodecanedicarboxylic acid, unsaturated aliphatic and alicyclic dicarboxylic acids such as fumaric acid, maleic acid, itaconic acid, mesaconic acid, citraconic acid, hexahydrophthalic acid, tetrahydrophthalic acid, dimer acid, trimer acid, hydrogenated dimer acid, cyclohexanedicarboxylic acid and cyclohexenedicarboxylic acid, as well as trivalent or higher polyvalent carboxylic acids such as trimellitic acid, trimesic acid and pyromellitic acid.

Examples of the polyhydric alcohol used in the preparation of the polyester resin include aliphatic polyhydric alcohols, alicyclic polyhydric alcohols and aromatic polyhydric alcohols. Specific examples of suitable aliphatic polyhydric alcohols include aliphatic diols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, dimethylolheptane, 2,2,4-trimethyl-1,3-pentanediol, polyethylene glycol, polypropylene glycol, polytetramethylene glycol, and lactone-based polyester polyols obtained by ring-opening polymerization of a lactone such as ∈-caprolactone, as well as triols and tetraols such as trimethylolethane, trimethylolpropane, glycerol and pentaerythritol. Specific examples of suitable alicyclic polyvalent alcohols include 1,4-cyclohexanediol, 1,4-cyclohexanedimethanol, spiroglycol, hydrogenated bisphenol A, ethylene oxide adducts and propylene oxide adducts of hydrogenated bisphenol A, tricyclodecanediol, tricyclodecanedimethanol, dimer diol and hydrogenated dimer diol.

Specific examples of suitable aromatic polyvalent alcohols include paraxylene glycol, metaxylene glycol, orthoxylene glycol, 1,4-phenylene glycol, ethylene oxide adducts of 1,4-phenylene glycol, bisphenol A, and ethylene oxide adducts and propylene oxide adducts of bisphenol A.

A monofunctional monomer may also be introduced into the polyester resin in order to block the polar groups at the polyester resin terminals, thereby improving the environmental stability of the toner charge characteristics. Examples of suitable monofunctional monomers include monocarboxylic acids such as benzoic acid, chlorobenzoic acid, bromobenzoic acid, parahydroxybenzoic acid, the monoammonium salt of sulfobenzoic acid, the monosodium salt of sulfobenzoic acid, cyclohexylaminocarbonylbenzoic acid, n-dodecylaminocarbonylbenzoic acid, t-butylbenzoic acid, naphthalenecarboxylic acid, 4-methylbenzoic acid, 3-methylbenzoic acid, salicylic acid, thiosalicylic acid, phenylacetic acid, acetic acid, propionic acid, butyric acid, isobutyric acid, octanecarboxylic acid, lauric acid, stearic acid, and lower alkyl esters of the above acids, as well as monoalcohols including aliphatic alcohols, aromatic alcohols and alicyclic alcohols.

In an exemplary embodiment of the present invention, the use of a polyvalent carboxylic acid containing at least 5 mol % of a cyclohexanedicarboxylic acid is desirable, and the quantity of this cyclohexanedicarboxylic acid within the polyvalent carboxylic acid is preferably within a range from 10 to 70 mol %, even more preferably from 15 to 50 mol %, and most preferably from 20 to 40 mol %. The cyclohexanedicarboxylic acid may use one or more of 1,4-cyclohexanedicarboxylic acid, 1,3-cyclohexanedicarboxylic acid and 1,2-cyclohexanedicarboxylic acid. Furthermore, a mixture of compounds that includes a compound in which a portion of the hydrogen atoms of the cyclohexane ring have been substituted with alkyl groups or the like may also be used. If the quantity of the cyclohexanedicarboxylic acid does not satisfy the above range, then the required fixing properties do not manifest satisfactorily, whereas if the quantity is too large, then the unit cost of the resin rises, which causes cost problems.

There are no particular restrictions on the method used for producing the crystalline polyester resin, and a typical polyester polymerization method in which the acid component and the alcohol component are reacted together is suitable. Specific examples include direct polycondensation methods and transesterification methods, and the method used may be selected in accordance with the nature of the monomers.

Production of the crystalline polyester resin can be conducted at a polymerization temperature within a range from 180 to 230° C., and if necessary the pressure within the reaction system may be reduced, so that water and alcohol generated during the condensation is removed while the reaction proceeds. In those cases where the monomers do not dissolve or are not compatible at the reaction temperature, a high boiling temperature solvent may be used as a dissolution assistant for dissolving the monomers. In a polycondensation reaction, the dissolution assistant is removed as the reaction proceeds. If a monomer with poor compatibility exists within a copolymerization reaction, then that monomer with poor compatibility may be first subjected to condensation with the acid or alcohol with which the monomer is to undergo polycondensation, and the resulting product then subjected to polycondensation with the primary component.

Examples of catalysts that may be used during production of the crystalline polyester resin include compounds of alkali metals such as sodium and lithium; compounds of alkaline earth metals such as magnesium and calcium; compounds of other metals such as zinc, manganese, antimony, titanium, tin, zirconium and germanium; as well as phosphite compounds, phosphate compounds, and amine compounds. Specific examples include the compounds listed below.

Namely, specific examples include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-t-butylphenyl) phosphite, ethyltriphenylphosphonium bromide, triethylamine, and triphenylamine. The quantity added of this type of catalyst is preferably within a range from 0.01 to 1.00% by weight relative to the combined weight of the raw materials.

The melting temperature of the crystalline resin is preferably within a range from 50 to 120° C., and even more preferably from 60 to 110° C. If the melting temperature is lower than 50° C., then problems may arise in terms of the storage properties of the toner, or the storage properties of the toner image following fixing. In contrast, if the melting temperature is higher than 120° C., then the low-temperature fixing may be unsatisfactory when compared with conventional toners.

In this description, the melting temperature of the crystalline resin is measured using a differential scanning calorimeter (DSC). The melting temperature is obtained as a melting peak temperature within a differential scanning calorimetry method conducted in accordance with ASTM D3418-8, when measurement is conducted from room temperature to 150° C. at a rate of temperature increase of 10° C. per minute. Measurement of the glass transition temperature of the non-crystalline polyester resin described below can be conducted in a similar manner.

Furthermore, although the crystalline resin may exhibit multiple melting peaks in some cases, in the present invention, the maximum peak is regarded as the melting temperature.

Moreover, the measurement of resin melting temperatures in the present invention can be conducted, for example, using a DSC-7 device manufactured by PerkinElmer Inc. In this device, temperature correction at the detection portion is conducted using the melting temperatures of indium and zinc, and correction of the heat quantity is conducted using the heat of fusion of indium. The sample is placed in an aluminum pan, and using an empty pan as a control, measurement is conducted at a rate of temperature increase of 10° C./minute. Measurement of the softening temperature of the non-crystalline polyester resin described below can be conducted in a similar manner.

The crystalline polyester resin used in a toner of an exemplary embodiment of the present invention has a weight average molecular weight (Mw), measured by gel permeation chromatography (GPC) of the tetrahydrofuran (THF) soluble fraction, that falls within a range from 10,000 to 25,000, and preferably from 20,000 to 25,000. If the weight average molecular weight is less than 10,000, then the resin is prone to co-dissolution with the non-crystalline resin or the release agent, causing plasticization. In contrast, if the weight average molecular weight exceeds 25,000, then the viscosity of the melted toner rises, which can cause a deterioration in the fixing properties and a loss in the level of image gloss. In this description, the molecular weight of a resin is determined by measuring the THF-soluble fraction of the resin, using a GPC-HLC-9120 apparatus and TSKGEL SUPER HM-M column (15 cm) manufactured by Tosoh Corporation and using THF solvent as the eluent, and then calculating the molecular weight from a molecular weight calibration curve prepared using monodisperse polystyrene standards. Measurement of the non-crystalline polyester resin described below is conducted in a similar manner.

A toner according to an exemplary embodiment of the present invention preferably uses a crystalline polyester resin for which the melting temperature (mp), measured in accordance with ASTM D3418-8, is within a range from 65 to 75° C. If the melting temperature is less than 65° C., then the hot storage properties of the toner deteriorate, whereas if the melting temperature exceeds 75° C., the image gloss upon toner fixation deteriorates.

The acid value of the crystalline polyester resin (the number of mg of KOH required to neutralize 1 g of the resin) is controlled within a range from 5 to 10 mgKOH/g. If the acid value is less than 5 mgKOH/g, then not only do the crystalline resin particles form aggregates, making formation of structures with the release agent more difficult, but the crystalline resin particles may also exist independently within the toner, or grow very large and protrude through to the surface of the toner, all of which are undesirable from the viewpoints of the fluidity and chargeability of the toner. In contrast, if the acid value exceeds 10 mgKOH/g, then encapsulating the resin within the toner becomes difficult, and generating a stable structure may be impossible.

—Non-Crystalline Polyester Resin—

The non-crystalline polyester resin is obtained mainly through a condensation polymerization of an aforementioned polyvalent carboxylic acid and polyhydric alcohol, using one of the catalysts described above.

The non-crystalline resin polyester resin can be produced by a condensation reaction of an aforementioned polyhydric alcohol and polyvalent carboxylic acid using conventional methods. In one example of a production method, the polyhydric alcohol, the polyvalent carboxylic acid, and where necessary a catalyst, are blended together in a reaction vessel fitted with a thermometer, a stirrer and a reflux condenser, the mixture is heated to a temperature of 150 to 250° C. under an inert gas atmosphere (of nitrogen gas or the like), and the reaction is continued until a predetermined acid value is reached, while by-product low molecular weight compounds are removed continuously from the reaction system. When the predetermined acid value is reached, the reaction is halted, the mixture is cooled, and the targeted reaction product is extracted.

The glass transition temperature of the non-crystalline polyester resin used in an exemplary embodiment of the present invention, determined in accordance with ASTM D3418-8, should be 50° C. or higher, and is preferably 55° C. or higher, even more preferably 60° C. or higher, and is most preferably 65° C. or higher but less than 90° C. If the glass transition temperature is less than 50° C., then the resin tends to aggregate during handling or storage, which can cause problems in terms of the storage stability. Furthermore, if the glass transition temperature is 90° C. or higher, then not only does the fixability deteriorate, but the fixing speed dependency tends to increase undesirably.

Furthermore, the softening temperature of the non-crystalline polyester resin used in the exemplary embodiment is preferably within a range from 60 to 90° C. In toners in which this resin softening temperature is less than 60° C., aggregation tends to occur during handling or storage, and particularly in the case of long-term storage, the fluidity of the toner may deteriorate markedly. Softening temperatures that exceed 90° C. may adversely effect the fixability. Furthermore, a high softening temperature means the fixing roller needs to be heated to a higher temperature, which restricts the materials that can be used for the fixing roller and the transfer substrate.

The non-crystalline polyester resin used in a toner of the present invention has a weight average molecular weight (Mw), measured by gel permeation chromatography (GPC) of the tetrahydrofuran (THF) soluble fraction, that falls within a range from 20,000 to 50,000, and preferably from 25,000 to 50,000. If this weight average molecular weight is less than 20,000, then not only do the hot storage properties of the toner tend to deteriorate, but the strength of the fixed image also deteriorates. In contrast, if the weight average molecular weight exceeds 50,000, then the fixing properties worsen and the level of image gloss deteriorates.

The acid value of the non-crystalline polyester resin is controlled within a range from 10 to 15 mgKOH/g. If the acid value is less than 10 mgKOH/g, then the growth of aggregate particles during toner manufacture accelerates, meaning the particle size distribution of the resulting toner tends to broaden undesirably. In contrast, if the acid value exceeds 15 mgKOH/g, then the difference in acid value between the crystalline polyester resin and the release agent becomes overly large, which may cause aggregation to proceed only between the crystalline polyester resin and the release agent, causing the proportion of the resulting structure to exceed the range prescribed within the present invention. The acid value of the non-crystalline polyester resin can be adjusted by controlling the quantity of carboxyl groups at the polyester terminals, by appropriate adjustments of the blend ratio between the polyvalent carboxylic acid and polyhydric alcohol raw materials, and the reaction rate. Alternatively, a polyester containing carboxyl groups at non-terminal positions within the principal chain can be obtained by using trimellitic anhydride as the polyvalent carboxylic acid component.

In a toner of the exemplary embodiment, the weight ratio between the crystalline polyester resin and the non-crystalline polyester resin is within a range from 5/95 to 40/60. If the proportion of the non-crystalline polyester resin is less than 60%, then although favorable fixing properties can be obtained, the phase-separated structures within the fixed image are non-uniform, meaning problems arise in that the strength of the fixed image, and particularly the scratch resistance of the image, deteriorate, meaning the image is prone to scratching. In contrast, if the proportion of the non-crystalline polyester resin exceeds 95%, then the sharp melting characteristics derived from the presence of the crystalline polyester resin are unobtainable, meaning simple plasticization may occur, and it becomes difficult to achieve favorable toner blocking resistance and image storage stability while retaining favorable low-temperature fixability.

Preparation of resin particle dispersions of the crystalline polyester resin and the non-crystalline polyester resin can be achieved by appropriate adjustment of the acid value of the resin and using an ionic surfactant or the like to effect an emulsification dispersion.

Furthermore, in those cases where the resin is prepared by another method, provided the resin dissolves in an oil-based solvent that exhibits comparatively low solubility in water, a resin particle dispersion can be prepared by dissolving the resin in this type of oil-based solvent, adding the resulting solution to water together with an ionic surfactant and a polymer electrolyte, dispersing the resulting mixture to generate a particle dispersion in water using a dispersion device such as a homogenizer, and then evaporating off the solvent either by heating or under reduced pressure. Furthermore, a resin particle dispersion can also be prepared by adding a surfactant to the resin, and then using either an emulsification dispersion method or a phase inversion emulsification method to disperse the mixture in water with a dispersion device such as a homogenizer.

The particle size of a resin particle dispersion obtained in this manner can be measured, for example, using a laser diffraction particle size distribution analyzer (LA-700, manufactured by Horiba, Ltd.).

—Release Agent—

Specific examples of suitable release agents for use within an exemplary embodiment of the present invention include low molecular weight polyolefins such as polyethylene, polypropylene and polybutene; silicones that exhibit a softening temperature under heating; fatty acid amides such as oleyl amide, erucyl amide, ricinoleyl amide and stearyl amide; vegetable waxes such as carnauba wax, rice wax, candelilla wax, Japan wax and jojoba oil; animal waxes such as beeswax; mineral or petroleum waxes such as montan wax, ozokerite, ceresin, paraffin wax, microcrystalline wax and Fischer-Tropsch wax; ester waxes of a higher fatty acid and a higher alcohol such as stearyl stearate and behenyl behenate; ester waxes of a higher fatty acid and a monovalent or polyvalent lower alcohol such as butyl stearate, propyl oleate, monostearyl glyceride, distearyl glyceride, and pentaerythritol tetrabehenate; ester waxes formed from a higher fatty acid and a polyvalent alcohol monomer such as diethylene glycol monostearate, dipropylene glycol distearate, distearyl diglyceride, and tetrastearyl triglyceride; sorbitan higher fatty acid ester waxes such as sorbitan monostearate; and cholesterol higher fatty acid ester waxes such as cholesteryl stearate. In the exemplary embodiment of the present invention, these release agents may be used either alone, or in combinations of two or more different materials. Furthermore, of the above materials, although any of those with melting temperatures within a range from 40 to 120° C. can be used in the exemplary embodiment, in order to satisfy recent demands for low-temperature fixability that enables reduced energy consumption, release agents with melting temperatures from 50 to 100° C. are preferred, and those with melting temperatures from 50 to 80° C. are particularly desirable.

The quantity added of the release agent is typically within a range from 0.5 to 50% by weight, preferably from 1 to 30% by weight, and even more preferably from 5 to 15% by weight relative to the total weight of the toner. If the quantity of the release agent is less than 0.5% by weight, then the effects of adding the release agent are minimal, whereas if the quantity exceeds 50% by weight, the chargeability is likely to be adversely affected, undesirable effects such as breakdown of the toner within the developing unit, the release agent becoming spent on the carrier, and deterioration in the chargeability become more likely, and in those cases where a color toner is used, inadequate exudation of the release agent out to the image surface during fixing becomes more likely, meaning the release agent may remain within the image, causing a deterioration in the transparency.

The volume average particle size of the wax particles within the release agent dispersion is preferably within a range from 0.1 to 0.5 μm, and even more preferably from 0.1 to 0.3 μm. If the volume average particle size exceeds 0.5 μm, then the particles are more likely to become exposed at the toner surface, which tends to cause a deterioration in the toner particle fluidity and increase the likelihood of filming occurring at the photoreceptor or the developing unit. Furthermore, other problems also arise in that encapsulation may not occur satisfactorily in the aggregation step, and drop-out of the release agent may occur in the fusion step. Particularly in the preparation of a color toner, if the release agent particles are too large, then diffuse reflection causes a deterioration in the OHP transparency, and the color reproducibility also deteriorates. The volume average particle size can be measured, for example, using a laser diffraction particle size distribution analyzer. If the volume average particle size is 0.1 μm or smaller, then a satisfactory level of releasability cannot be imparted to the toner.

The dispersion medium for the release agent dispersion is preferably a water-based system, and may use water, purified water, or ion-exchanged water. A surfactant may be used as a dispersant. The wax dispersion used in a toner of the present invention can be prepared by conventional methods, using a media disperser such as a ball mill, sand mill or attritor, or a high-pressure disperser such as a nanomizer, microfluidizer, altimizer or GAULIN homogenizer, and provided the particle size and quantity of the release agent satisfy the ranges described above, any suitable method and preparation conditions may be used.

—Colorant—

The quantity of the colorant within the toner is typically an effective quantity, for example from approximately 1 to approximately 15% by weight, and preferably from approximately 3 to approximately 10% by weight, of the toner. There are no particular restrictions on the colorants used in a manufacturing method of the present invention, and suitable examples include conventionally known colorants, which may be selected in accordance with the intended purpose of the toner. Single pigments may be used alone, or mixtures of two or more pigments of the same family may be used. Furthermore, mixtures of two or more pigments from different families may also be used. Specific examples of suitable colorants include carbon blacks such as furnace black, channel black, acetylene black and thermal black; inorganic pigments such as red iron oxide, aniline black, iron blue, titanium oxide and magnetic powders; azo pigments such as fast yellow, monoazo yellow, disazo yellow, pyrazolone red, chelate red, brilliant carmine (such as 3B and 6B) and para brown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet.

Further examples include various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green and malachite green oxalate; and various dyes such as acridine-based dyes, xanthene-based dyes, azo-based dyes, benzoquinone-based dyes, azine-based dyes, anthraquinone-based dyes, dioxazine-based dyes, thiazine-based dyes, azomethine-based dyes, indigo-based dyes, thioindigo-based dyes, phthalocyanine-based dyes, aniline black-based dyes, polymethine-based dyes, triphenylmethane-based dyes, diphenylmethane-based dyes and thiazole-based dyes. Black pigments such as carbon black or dyes may also be mixed with the colorant, provided no significant deterioration occurs in the degree of transparency. Moreover, disperse dyes and oil-soluble dyes may also be used.

The dispersion medium for the colorant dispersion is preferably a water-based system, and may use water, purified water, or ion-exchanged water. A surfactant may be used as a dispersant. The colorant dispersion used in a toner of the present invention can be prepared by conventional methods, using a media disperser such as a ball mill, sand mill or attritor, or a high-pressure disperser such as a nanomizer, microfluidizer, altimizer or GAULIN homogenizer, and provided the particle size and quantity of the colorant satisfy the range of described below, for example, the range described in examples section, any suitable method and preparation conditions may be used.

<Other Components>

There are no particular restrictions on other components that may be used in a toner for developing an electrostatic latent image according to an exemplary embodiment of the present invention, and such components may be selected according to need. Examples of these other components include conventional additives such as inorganic particles, organic particles, charge control agents and other release agents.

The inorganic particles mentioned above are typically added to a toner to improve the toner fluidity. Examples of suitable inorganic materials include particles of silica, alumina, titanium oxide, barium titanate, magnesium titanate, calcium titanate, strontium titanate, zinc oxide, silica sand, clay, mica, wollastonite, silious earth, cerium chloride, red iron oxide, chromium oxide, cerium oxide, antimony trioxide, magnesium oxide, zirconium oxide, silicon carbide and silicon nitride. Of these, silica particles are preferred, and hydrophobically treated silica particles are particularly desirable.

The average primary particle size (number average particle size) of these inorganic particles is preferably within a range from 1 to 1,000 nm, and the quantity added (as an external additive) is preferably within a range from 0.01 to 20 parts by weight per 100 parts by weight of the toner.

Organic particles are typically added to improve the cleaning properties and transferability, and sometimes the chargeability, of the toner. Examples of suitable organic materials include particles of polystyrene, polymethyl methacrylate, polyvinylidene fluoride and polystyrene-acrylic copolymers.

Charge control agents are generally used for improving the chargeability of the toner. Examples of suitable charge control agents include metal salicylates, metal-containing azo compounds, nigrosine and quaternary ammonium salts.

<Toner Structure>

A toner of an exemplary embodiment of the present invention contains at least a non-crystalline polyester resin, a crystalline polyester resin, a release agent and a colorant. The ruthenium-stained cross section of the toner is inspected using a transmission electron microscope, and the resulting image is then analyzed.

Figure 2:
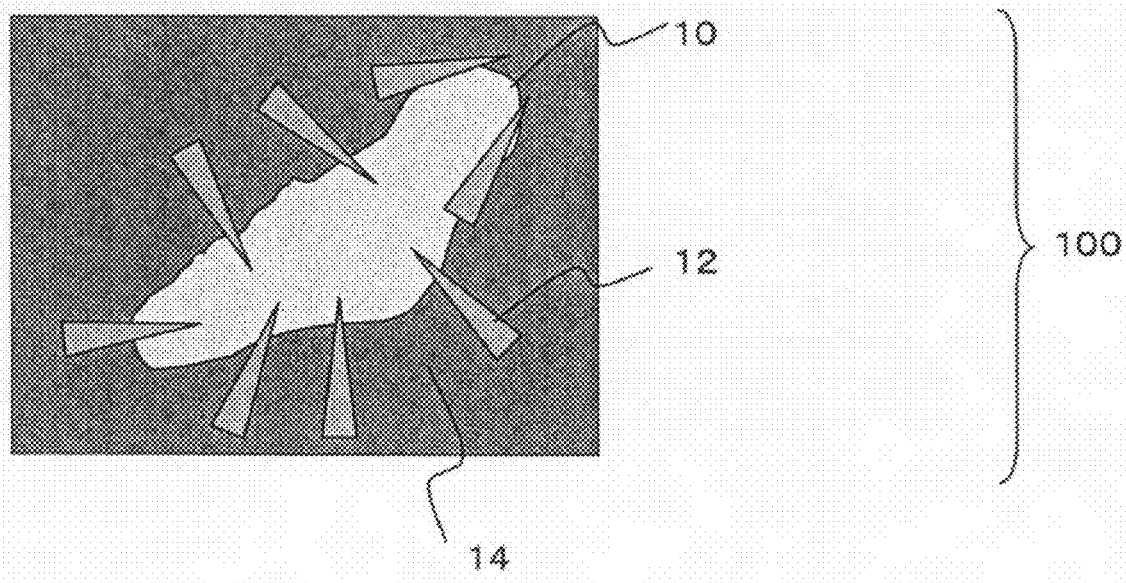
FIG. 2 is a schematic illustration describing a structure within a toner particle of an exemplary embodiment of the present invention.

Ruthenium staining of a toner according to the exemplary embodiment is conducted using conventional methods, and measurement may be conducted, for example, using the method described below. Namely, the toner is embedded in a epoxy resin, and then sliced into sections of thickness 100 nm using a microtome. The resulting toner cross sections are then inspected using a transmission electron microscope (TEM) to confirm the existence of structures in which the crystalline polyester resin contacts the release agent. Staining is conducted using a 0.5% aqueous solution of ruthenium tetroxide. Contrast and shape are used to distinguish the crystalline polyester resin and the release agent. As shown in FIG. 2, the rod-shaped or lump-shaped portion is identified as the release agent 10, whereas the linear crystals that are positioned as protrusions around the periphery of the release agent and scattered throughout the interior of the non-crystalline polyester resin 14 are identified as the crystalline polyester resin 12. Furthermore, in terms of contrast, the whiter portion is identifiable as the release agent 10. Because the binder resins other than the release agent contain large numbers of double bonds, they are stained by the ruthenium tetroxide, meaning the release agent portions can be readily distinguished from the resin portions. In other words, as shown in FIG. 2, the ruthenium staining process stains the release agent 10 the lightest color, the crystalline polyester resin 12 is stained more darkly, and the non-crystalline polyester resin 14 is stained the darkest. Appropriate adjustments are made to ensure that each sliced section includes the cross sections of approximately 50 toner particles.

Using this process, the toner cross section is confirmed as containing structures 100 in which the crystalline polyester resin contacts the release agent, lone portions of the release agent 10, and lone portions of the crystalline polyester resin 12, all contained within the non-crystalline polyester resin 14. In a toner of the present invention, if the cross-sectional area of the above structures is labeled A, the cross-sectional area of the lone portions of the release agent is labeled B, and the cross-sectional area of the lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$, and in a preferred configuration $50 \leqq 100 \times A/(A+B+C) \leqq 70$, $10 \leqq 100 \times B/(A+B+C) \leqq 20$, and $20 \leqq 100 \times C/(A+B+C) \leqq 30$.

If the area of the above structures is less than 40%, then the crystalline resin becomes prone to either exposure at the toner surface or co-dissolution with the non-crystalline resin, which can induce plasticization, the hot storage properties of the toner deteriorate, and the toner becomes prone to offset in high-temperature fixing regions. Furthermore, if the area of the structures exceeds 70%, then although plasticization caused by co-dissolution with the non-crystalline polyester resin can be suppressed, co-dissolution or mixing with the release agent tends to occur, causing an increase in the viscosity of the release agent, which may cause a deterioration in the releasability during oil-less fixing.

If the proportion of lone portions of the release agent is less than 10%, then this indicates a reduced level of the releasability that represents the fundamental function of the release agent, which can cause problems such as an increased variation in releasability between toner particles, and deterioration in the overall releasability. In contrast, if the proportion of lone portions of the release agent exceeds 30%, then although the releasability improves, migration of the crystalline polyester resin into the recording medium becomes increasingly likely, and the recrystallization of this crystalline polyester resin upon cooling can cause a deterioration in the adhesion between the image and the recording medium. Furthermore, if the proportion of lone portions of the crystalline polyester resin is less than 20%, then similar problems are observed to the case in which the proportion of lone portions of the release agent is less than 10%. On the other hand, if the proportion of lone portions of the crystalline polyester resin exceeds 30%, then similar problems are observed to the case in which the proportion of lone portions of the release agent exceeds 30%.

<Toner Properties>

The volume average particle size of a toner according to an exemplary embodiment of the present invention is preferably within a range from 1 to 12 μm, even more preferably from 3 to 9 μm, and most preferably from 3 to 8 μm. Furthermore, the number average particle size of a toner according to an exemplary embodiment is preferably within a range from 1 to 10 μm, and even more preferably from 2 to 8 μm. If the particle size is too small, then not only does the production become unstable, but controlling the encapsulated structure becomes more difficult, which may result in insufficient chargeability and a deterioration in the developing properties. In contrast, if the particle size is too large, the resolution of the image deteriorates.

Furthermore, a toner according to an exemplary embodiment of the present invention preferably has a volume average particle size distribution index GSDv that is no greater than 1.30. Furthermore, the ratio between the volume average particle size distribution index GSDv and the number average particle size distribution index GSDp (namely, GSDv/GSDp) is preferably 0.95 or greater. If the volume average particle size distribution index GSDv exceeds 1.30, then the resolution of the image may deteriorate, whereas if the ratio (GSDv/GSDp) between the volume average particle size distribution index GSDv and the number average particle size distribution index GSDp is less than 0.95, then problems such as a deterioration in toner chargeability, and scattering and fogging of the toner may occur, increasing the likelihood of image defects.

In an exemplary embodiment of the present invention, the toner particle size and the values for the aforementioned volume average particle size distribution index GSDv and number average particle size distribution index GSDp are measured and/or calculated in the manner described below. First, the toner particle size distribution measured using a COULTER MULTISIZER II (manufactured by Beckman Coulter, Inc.) is divided into particle size ranges (channels), and cumulative distribution curves are drawn beginning at the smaller particle sizes for the volume and number of each of the toner particles. On these curves, the particle size at the point where the accumulated value reaches 16% is defined as the volume average particle size D16v or the number average particle size D16p respectively, and the particle size at the point where the accumulated value reaches 50% is defined as the volume average particle size D50v or the number average particle size D50p respectively. Similarly, the particle size at the point where the accumulated value reaches 84% is defined as the volume average particle size D84v or the number average particle size D84p respectively. The volume average particle size distribution index (GSDv) is defined as D84v/D16v, and the number average particle size distribution index (GSDp) is defined as D84p/D16p, and these relational expressions can be used to calculate the volume average particle size distribution index (GSDv) and the number average particle size distribution index (GSDp).

The absolute value of the charge quantity of a toner according to an exemplary embodiment of the present invention is preferably within a range from 15 to 60 μC/g, and even more preferably from 20 to 50 μC/g. If this charge quantity is less than 15 μC/g, then background staining (fogging) becomes more likely, whereas if the charge quantity exceeds 60 μC/g, the image density becomes prone to deterioration. Furthermore, the ratio between the charge quantity of the toner in summer (high temperature, high humidity) and the charge quantity of the toner in winter (low temperature, low humidity) is preferably within a range from 0.5 to 1.5, and even more preferably from 0.7 to 1.3. A ratio outside this range indicates a strong environmental dependency for the charge quantity, which can cause instability in the charging and is undesirable from a practical perspective.

From the viewpoint of image formability, the shape factor SF1 of a toner according to an exemplary embodiment of the present invention preferably satisfies $110 \leqq SF1 \leqq 140$. This shape factor SF1 is calculated as a shape factor average value (the square of the boundary value/the projected area) using the method described below. Namely, an optical microscope image of a toner scattered on a slide glass is loaded into a LUZEX image analyzer via a video camera, the value of (the square of the maximum length)$\times\pi\times 100$/(the projected area$\times$4) is calculated for 100 toner particles, and the average value of these shape factors is then calculated.

In a toner of an exemplary embodiment of the present invention, from the viewpoint of fixability, the maximum endothermic peak determined by differential thermal analysis is preferably within a range from 70 to 120° C., even more preferably from 70 to 90° C., and most preferably from 85 to 90° C.

The toner melting temperature, can be determined as the melting peak temperature in an input-compensated differential scanning calorimetry measurement conducted in accordance with JIS K-7121-87. The toner may include a crystalline resin that exhibits multiple melting temperatures as well as the release agent, although in those cases where the toner exhibits multiple melting peaks, the maximum peak is regarded as the melting temperature.

[Method of Manufacturing Toner]

As follows is a description of a method of manufacturing a toner according to the present invention.

Japanese Patent Laid-Open Publication No. 2001-255698 proposes a method of manufacturing a small particle size toner in which shape control can be used to ensure a uniform particle size, wherein a predetermined inorganic salt is added to a water-based medium to enable superior shape control. However, achieving the necessary toner melt fluidity for obtaining satisfactory fixability at high process speeds is difficult.

In toners that include crystalline material, although co-dissolution occurs during the toner production process, thermodynamic stability factors typically cause crystal growth to occur, which moderates the co-dissolution. As a result, of the various fixing properties, the folding resistance of the fixed image is particularly prone to deterioration. Accordingly, in an exemplary embodiment of the present invention, the emulsification step described below is conducted in order to improve the co-solubility of the crystalline polyester resin and the non-crystalline polyester resin.

—Emulsification Step—

In an emulsification step of the present invention, one or more crystalline resins and one or more non-crystalline polyester resins are first heated at a temperature that is greater than the higher of the melting temperature and glass transition temperature of the resins but lower than the boiling temperature of the solvent used, thereby dissolving the resins to form a uniform solution. Subsequently, a basic aqueous solution is added as a neutralizing agent, and with the pH maintained at a value from 7 to 9, pure water is added to the solution while stirring and shearing forces are applied to the mixture, thereby causing a phase inversion and generating an O/W emulsion of the resins. Subsequently, the solvent is removed from the emulsion by distillation under reduced pressure, thus yielding a resin particle dispersion.

The pH following neutralization is preferably within a range from 7 to 9, and even more preferably from 7 to 8. Examples of basic aqueous solutions that may be used include ammonium aqueous solutions and solutions of alkali metal hydroxides such as sodium hydroxide and potassium hydroxide. If the pH is less than 7, then large particles tend to develop within the emulsion, whereas if the pH exceeds 9, the size of the aggregate particles generated in the subsequent aggregation step tend to be undesirably large.

By using particles in which the crystalline polyester resin and the non-crystalline polyester resin have been co-dissolved in the manner described above, the release agent particles are more likely to aggregate with resin particle portions of lower acid value, meaning a toner that contains the structures of the present invention can be obtained.

<Emulsified Dispersion>

The average particle size of the above resins is typically no more than 1 μm, and is preferably within a range from 0.01 to 1 μm. If this average particle size exceeds 1 μm, then the particle size distribution of the final electrostatic latent image toner tends to broaden, the occurrence of free particles increases, and the properties and reliability of the toner tend to deteriorate. On the other hand, if the above average particle size falls within the range specified above, then not only do these problems not occur, but uneven distribution within the toner is reduced, dispersion within the toner improves, and fluctuations in the properties and reliability of the toner decrease. The average particle size can be measured, for example, using a COULTER MULTISIZER or laser diffraction particle size analyzer.

Examples of the dispersion medium used in the above dispersion include water-based mediums and organic solvents and the like.

Examples of suitable water-based mediums include water such as distilled water or ion-exchanged water, as well as mixtures with alcohols, ethyl acetate or ketones. These mediums may be used alone, but are preferably used in combinations containing two or more different materials.

In the present invention, a surfactant may also be added to the water-based medium. There are no particular restrictions on the surfactant, and suitable examples include anionic surfactants such as sulfate ester-based surfactants, sulfonate-based surfactants, phosphate ester-based surfactants and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants and polyhydric alcohol-based surfactants. Of these, anionic surfactants and cationic surfactants are preferred. The use of the above nonionic surfactants in combination with an anionic surfactant or cationic surfactant is also preferred. These surfactants may be used either alone, or in combinations of two or more different materials.

Specific examples of the above anionic surfactants include sodium dodecylbenzenesulfonate, sodium dodecylsulfate, sodium alkylnaphthalenesulfonate and sodium dialkylsulfosuccinate. Specific examples of the above cationic surfactants include alkylbenzenedimethylammonium chloride, alkyltrimethylammonium chloride and distearylammonium chloride. Of the above surfactants, ionic surfactants such as anionic surfactants and cationic surfactants are preferred.

Examples of the aforementioned organic solvents include ethyl acetate, methyl ethyl ketone, acetone, toluene, and alcohols such as isopropyl alcohol, and these solvents can be selected in accordance with the aforementioned binder resins.

In those cases where the resin particles described above contain a crystalline polyester resin and a non-crystalline polyester resin, the particles contain functional groups that are capable of forming anions in the presence of a neutralizing agent and consequently exhibit self-dispersibility in water. Accordingly, the resin particles are able to form a stable water dispersion under the action of a water-based medium in which either a portion of, or all of, the functional groups capable of exhibiting hydrophilicity are neutralized by a base. In the crystalline polyester resin and the amorphous polyester resin, because the functional groups capable of exhibiting hydrophilicity upon neutralization are acidic groups such as carboxyl groups and sulfone groups, examples of suitable neutralizing agents include inorganic bases such as sodium hydroxide, potassium hydroxide, lithium hydroxide, calcium hydroxide, sodium carbonate and ammonia, as well as organic bases such as diethylamine, triethylamine and isopropylamine.

Furthermore, in those cases where a polyester resin is used that is itself not dispersible in water, namely, a resin that exhibits no self-dispersibility in water, then in a similar manner to that described below for the release agent, particles with a particle size of no more than 1 μm can be obtained relatively easily by dispersing a solution of the resin and/or a water-based medium together with an ionic surfactant and a polymer electrolyte such as a polymeric acid or polymeric base, and then heating the resulting mixture to a temperature at least as high as the melting temperature, and conducting treatment using a homogenizer or pressure discharge disperser capable of imparting a powerful shearing force. When these types of ionic surfactant and polymer electrolyte are used, their concentration within the water-based medium is typically within a range from approximately 0.5 to 5% by weight.

Although described in further detail below in relation to toner manufacture, the non-crystalline polyester resin and the crystalline polyester resin may be blended with the colorant and/or the release agent, may be dissolved in a suitable solvent and then blended, or may be first converted into separate emulsions, subsequently mixed and aggregated, and then fused and blended. In the case of melt mixing and blending, the toner is preferably prepared using a grinding method. In the case of solvent dissolution followed by blending, a toner production method in which wet aggregation is conducted together with the solvent and a dispersion stabilizer is preferred. In the case of mixing separate emulsions, although there are no particular restrictions on the method used, a wet production method that yields toners particles within water, such as an aggregation method, suspension polymerization method or dissolution suspension method is preferred as it enables more favorable shape control, which reduces the likelihood of toner destruction within the developing unit. Toner preparation using an aggregation fusion method using emulsions, which provides favorable shape control and enables ready formation of a resin coating layer, is particularly desirable. Toner preparation using an aggregation fusion method using emulsions is also desirable in terms of enabling favorable particle size control and enabling formation of a surface coating layer.

Examples of suitable emulsification devices for use in forming the emulsified particles include a homogenizer, homomixer, cavitron, clearmix, pressure kneader, extruder and media disperser.

The aggregation method described above is a manufacturing method that includes: mixing together a resin particle dispersion produced by dispersing resin particles, a colorant particle dispersion produced by dispersing colorant particles, and a release agent particle dispersion produced by dispersing a release agent; forming an aggregate particle dispersion of aggregate particles containing the resin particles, the colorant particles and the release agent particles, and fusing the aggregate particles by heating the aggregate particles obtained upon aggregation. The above resin particle dispersion is a mixture of a dispersion of crystalline polyester resin particles and a dispersion of non-crystalline polyester resin particles, and this resin particle dispersion is mixed with the release agent dispersion, and the resulting mixture is then subjected to aggregation and fusion, thus yielding the toner particles.

Specifically, the resin particle dispersion that includes an ionic surfactant is prepared using a typical emulsion polymerization method, this dispersion is mixed with the colorant particle dispersion and the release agent particle dispersion, aggregate particles of toner size are generated by hetero-aggregation with a coagulant with the opposite polarity to the ionic surfactant, heating is then conducted to a temperature at least as high as the glass transition temperature of the resin particles, thereby fusing the aggregate particles, and the fused particles are then washed and dried, yielding a toner.

In the case of the above release agent dispersion, the release agent is dispersed within the electrostatic latent image toner in the form of particles with a volume average particle size within a range from 150 to 1,500 nm. By including from 1 to 25% by weight of such release agent particles, the releasability of the fixed image in an oil-less fixing method can be improved. A preferred range for the volume average particle size is from 160 to 1,400 nm, and a preferred addition quantity is from 5 to 20% by weight.

A dispersion of release agent particles of no more than 1 μm can be prepared by dispersing the release agent in water, together with an ionic surfactant and a polymer electrolyte such as a polymeric acid or polymeric base, and then heating to a temperature at least as high as the melting temperature, while effecting conversion to particle form by using a homogenizer or pressure discharge disperser to impart a powerful shearing force.

The concentration of the surfactant used in the release agent dispersion is preferably no more than 4% by weight relative to the quantity of release agent. If this quantity exceeds 4% by weight, then the rate of aggregation during particle formation slows and the heating time lengthens, causing an undesirable increase in the level of aggregates.

Furthermore, in the case of the above colorant dispersion, the colorant is dispersed within the electrostatic latent image toner in the form of particles with a volume average particle size within a range from 100 to 330 nm, and by including from 4 to 15% by weight of such colorant particles, the coloring properties and the OHP transparency can be improved. A preferred range for the volume average particle size is from 120 to 310 nm, and a preferred addition quantity is from 5 to 14% by weight.

The colorant may be dispersed by conventional methods, and examples of particularly favorable dispersion devices include a revolving shearing homogenizer, media dispersers such as a ball mill, sand mill, attritor or coball mill, roll mills such as a triple roll mill, cavitation mills such as a nanomizer, a colloid mill, and a high pressure counter collision type disperser.

In a method of manufacturing a toner according to the present invention, examples of the surfactants that are used in the emulsion polymerization of the resin particles, the dispersion of the colorant, the addition and dispersion of the resin particles, the dispersion of the release agent, and the aggregation and stabilization of these dispersions include anionic surfactants such as sulfate ester-based surfactants, sulfonate-based surfactants, phosphate ester-based surfactants and soap-based surfactants, and cationic surfactants such as amine salt-based surfactants and quaternary ammonium salt-based surfactants. Furthermore, the use of nonionic surfactants such as polyethylene glycol-based surfactants, alkylphenol ethylene oxide adduct-based surfactants or polyhydric alcohol-based surfactants in combination with the above ionic surfactants is also effective. Dispersion of these surfactants is generally conducted using a revolving shearing homogenizer, or a media-containing ball mill, sand mill or dyno mill.

Furthermore, in those cases where colorant particles coated with polar resin particles are used, a method in which the resin and the colorant are dissolved and dispersed in a solvent (such as water, a surfactant and an alcohol), and subsequently dispersed in water together with a suitable dispersant (including a surfactant), before the solvent is removed, either by heating or under reduced pressure, or a method in which the colorant particles are fixed on the surface of resin particles prepared by emulsion polymerization, either by a mechanical shearing force or by electrical adsorption, may be employed. These methods are effective in suppressing release of the colorant added to the aggregate particles, and in improving the dependency of the chargeability on the colorant.

Furthermore, the targeted toner is usually obtained by conducting arbitrary washing, solid-liquid separation and drying steps after the completion of the fusion process. In the washing step, thorough displacement washing with ion-exchanged water is preferably conducted to ensure favorable manifestation and retention of the chargeability characteristics. Although there are no particular restrictions on the solid-liquid separation, from the viewpoint of productivity, methods such as suction filtration, pressure filtration, centrifugal filtration and decanting are preferred. Moreover, although there are also no particular restrictions on the method using for the drying step, from the viewpoint of productivity, drying devices such as through-flow dryers, spray dryers, rotary dryers, flash dryers, fluidized-bed dryers, heat exchange dryers and freeze dryers are preferred.

Furthermore, in order to impart more favorable fluidity and improve the cleaning properties of the toner, metal salts such as calcium carbonate, metal oxide compounds such as silica, alumina, titania, barium titanate, strontium titanate, calcium titanate, cerium oxide, zirconium oxide and magnesium oxide, inorganic particles such as ceramics and carbon black, or resin particles such as vinyl resins, polyesters and silicones may be added to the toner surface in a dry state by application of shearing force, in a similar manner to that employed in conventional toner manufacturing methods.

The aforementioned inorganic particles are preferably subjected to surface treatment with a coupling agent or the like to ensure better control of factors such as conductivity and chargeability. Specific examples of such coupling agents include silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,N-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxychlorohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane, as well as titanium coupling agents.

The method of adding these particles may involve either adhering the particles to the toner surface in a dry state using a mixer such as a V-blender or HENSCHEL mixer, or dispersing the particles in water or a water-based liquid such as a water/alcohol mixture, adding the dispersion to a toner slurry, and then drying the mixture, thereby adhering the external additive to the toner surface. Furthermore, the addition may also be conducted by spraying a slurry onto a dry powder, while simultaneously conducting drying.

[Developer]

Next is a description of a developer according to the present invention.

There are no particular restrictions on a developer of the present invention, provided it includes an aforementioned toner according to the present invention, and the composition of the developer may be determined in accordance with the intended purpose. A developer of the present invention may be either a one-component developer in which the toner is used alone, or a two-component developer that uses a combination of the toner and a carrier.

There are no particular restrictions on the carrier, and conventional carriers such as the resin-coated carriers disclosed in Japanese Patent Laid-Open Publication No. Sho 62-39879 and Japanese Patent Laid-Open Publication No. Sho 56-11461 may be used.

Specific examples of suitable carriers include the resin-coated carriers described below. Examples of suitable core particle for these carriers include typical iron powder, ferrite and magnetite structures, and the volume average particle size of these core particles is typically within a range from approximately 30 to 200 μm.

Examples of the coating resin for these resin-coated carrier include homopolymers or copolymers of two or more monomers selected from amongst styrenes such as styrene, parachlorostyrene and α-methylstyrene; α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylate compounds such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and vinyl-based fluorine-containing monomers such as vinylidene fluoride, tetrafluoroethylene and hexafluoroethylene; as well as silicone resins containing methylsilicone or methylphenylsilicone or the like, polyesters containing bisphenol or glycol, epoxy resins, polyurethane resins, polyamide resins, cellulose resins, polyether resins, and polycarbonate resins. These resins may be used either alone or in combinations of two or more different resins. The quantity of the coating resin is preferably within a range from approximately 0.1 to 10 parts by weight, and even more preferably from approximately 0.5 to 3.0 parts by weight, per 100 parts by weight of the aforementioned core particles.

Production of the carrier can be conducted using a heated kneader, a heated HENSCHEL mixer or a UM mixer or the like. Depending on the quantity of the coating resin, a heated fluidized rolling bed or heated kiln or the like may also be used.

In a developer according to the present invention, there are no particular restrictions on the mixing ratio between the toner and the carrier, which can be selected appropriately in accordance with the intended application.

The particle size distribution of a carrier according to an exemplary embodiment of the present invention is preferably no greater than 1.3. The method used for measuring the particle size distribution is described below. If the carrier particle size distribution exceeds 1.3, then the fluidity of the developer tends to worsen, meaning agitation or the like within the developing unit tends to cause aggregation of the developer, which may result in problems such as streaking caused by developer blockages or the like.

The particle size distribution of the carrier is expressed as a weight distribution. Specifically, 100 g of the carrier is passed through multiple sieves with differing mesh sizes, and the particle size distribution is then represented by the weight of the carrier retained on each sieve. In the present invention, sieves with mesh sizes ranging in a stepwise manner from 10 μm to 100 μm are arranged in order, with the sieve with the smallest mesh size at the bottom and the sieve with a mesh size of 100 μm at the top, a sample of the carrier is placed on top of the 100 μm sieve, the sample is subjected to sonic oscillation, and the weight of the carrier retained on each sieve is then measured. If the total weight of the carrier passed through the sieves is defined as 100, then the particle size at which the accumulated weight, counting from the bottom, reaches 16% is termed D16, the particle size at which the accumulated weight reaches 84% is termed D84, and the particle size distribution is represented by the formula $(D84/D16)^{0.5}$. Depending on the mesh sizes of the sieves, exact weights of 16% and 84% corresponding with D16 and D84 may not necessarily be obtainable. In such cases, D16 is determined using the calculation described below.

1. The sieve where the accumulated weight reaches 16% is termed A μm, and the accumulated weight of the carrier, counted from the bottom and including the weight of the carrier left on this sieve, is termed a.

2. The sieve one step below the sieve where the accumulated weight reaches 16% is termed B μm, and the accumulated weight of the carrier, counted from the bottom and including the weight of the carrier left on this sieve, is termed b.

3. $D16=\{(16-b)/(a-b)\}\times(A-B)+B$

Furthermore, D84 is determined using the calculation described below.

4. The sieve where the accumulated weight reaches 84% is termed C μm, and the accumulated weight of the carrier, counted from the bottom and including the weight of the carrier left on this sieve, is termed c.

5. The sieve one step below the sieve where the accumulated weight reaches 84% is termed D μm, and the accumulated weight of the carrier, counted from the bottom and including the weight of the carrier left on this sieve, is termed d.

6. $D84=\{(84-d)/(c-d)\}\times(C-D)+D$

Using the above method, the values of D16 and D84 can be determined even in those cases where the spacing of the mesh within the sieve varies.

In a specific example, if the accumulated weight at a 20 μm mesh is 12%, the accumulated weight at a 25 μm mesh is 30%, the accumulated weight at a 75 μm mesh is 70%, and the accumulated weight at a 100 μm mesh is 90%, then $$D16=\{(16-12)/(30-12)\times(25-20)+20=21.1\ \mu m$$

$$D84=\{(84-70)/(90-70)\times(100-75)+75=92.5\ \mu m$$

The sieves used in the present invention and the mesh sizes of those sieves include HD10 (10 μm), HC-15 (15 μm), P-25 (25 μm), NY31-HC (31 μm), DIN120-45 (45 μm), NY50-HD (50 μm), HC-60 (60 μm), DIN80-75 (75 μm) and NY100-HC (100 μm) (all manufactured by Tanaka Sanjiro Co., Ltd.).

Examples of methods of ensuring that the particle size distribution of the carrier is no greater than 1.3 include methods in which a carrier with a broad particle size distribution is first prepared, and this carrier is then passed through sieves with mesh sizes smaller and larger than the average particle size so that the particles with the smallest and largest particle sizes are removed, and methods in which a technique such as air flow classification is used to separate and remove particles with small or large particle sizes.

<Image Forming Apparatus>

Next is a description of an image forming apparatus according to an exemplary embodiment of the present invention.

FIG. 1 is a schematic illustration showing a sample configuration of an image forming apparatus that forms an image using an image forming method according to an exemplary embodiment of the present invention. The image forming apparatus 200 shown in the drawing includes four electrophotographic photoreceptors 401*a* to 401*d* positioned in a mutually parallel arrangement along an intermediate transfer belt 409 inside a housing 400. These electrophotographic photoreceptors 401*a* to 401*d* are configured so that, for example, the electrophotographic photoreceptor 401*a* is capable of forming a yellow image, the electrophotographic photoreceptor 401*b* is capable of forming a magenta image, the electrophotographic photoreceptor 401*c* is capable of forming a cyan image, and the electrophotographic photoreceptor 401*d* is capable of forming a black image.

The electrophotographic photoreceptors 401*a* to 401*d* are each capable of rotating in a predetermined direction (in a counterclockwise direction within the plane of the drawing), and around this rotational direction there are provided charging rollers 402*a* to 402*d*, developing units 404*a* to 404*d*, primary transfer rollers 410*a* to 410*d*, and cleaning blades 415*a* to 415*d* respectively. The four colored toners, namely the black, yellow, magenta and cyan toners housed within toner cartridges 405*a* to 405*d* can be supplied to the developing units 404*a* to 404*d* respectively. Furthermore, the primary transfer rollers 410*a* to 410*d* contact the respective electrophotographic photoreceptors 401*a* to 401*d* across the intermediate transfer belt 409.

An exposure unit 403 is also positioned at a predetermined location inside the housing 400, and the light beam emitted from the exposure unit 403 is able to be irradiated onto the surfaces of the charged electrophotographic photoreceptors 401*a* to 401*d*. Accordingly, rotating the electrophotographic photoreceptors 401*a* to 401*d* enables the processes of charging, exposure, developing, primary transfer and cleaning to be conducted in sequence, thereby transferring and superimposing the toner image for each color onto the intermediate transfer belt 409.

In this description, the charging rollers 402*a* to 402*d* are used for bringing a conductive member (the charging roller) into contact with the surface of the respective electrophotographic photoreceptor 401*a* to 401*d*, thereby applying a uniform voltage to the photoreceptor and charging the photoreceptor surface to a predetermined potential (the charging step). Besides the charging rollers shown in this exemplary embodiment, charging may also be conducted using contact charging systems that employ charging brushes, charging films or charging tubes. Furthermore, charging may also be conducted using non-contact systems that employ a corotron or a scorotron.

The exposure unit 403 may employ an optical device that enables a light source such as a semiconductor laser, an LED (light emitting diode) or a liquid crystal shutter to be irradiated onto the surface of the electrophotographic photoreceptors 401*a* to 401*d* with a desired image pattern. Of these possibilities, if an exposure unit that is capable of irradiating incoherent light is used, then the generation of interference patterns between the conductive base material and the photosensitive layer of the electrophotographic photoreceptors 401*a* to 401*d* can be prevented.

For the developing units 404*a* to 404*d*, typical developing units that use an aforementioned two-component electrostatic latent image developer to conduct developing via either a contact or non-contact process may be used (the developing step). There are no particular restrictions on these types of developing units, provided they use a two-component electrostatic latent image developer, and appropriate conventional units may be selected in accordance with the desired purpose. In the primary transfer step, a primary transfer bias of the reverse polarity to the toner supported on the image holding member is applied to the primary transfer rollers

410*a* to 410*d*, thereby effecting sequential primary transfer of each of the colored toners to the intermediate transfer belt 409.

The cleaning blades 415 to 415*d* are used for removing residual toner adhered to the surfaces of the electrophotographic photoreceptors following the transfer step, and the resulting surface-cleaned electrophotographic photoreceptors are then reused within the above image forming process. Suitable materials for the cleaning blades include urethane rubbers, neoprene rubbers and silicone rubbers.

The intermediate transfer belt 409 is supported at a predetermined level of tension by a drive roller 406, a backup roller 408 and a tension roller 407, and can be rotated without slack by rotation of these rollers. Furthermore, a secondary transfer roller 413 is positioned so as to contact the backup roller 408 across the intermediate transfer belt 409.

By applying a secondary transfer bias of the reverse polarity to the toner on the intermediate transfer belt to the secondary transfer roller 413, the toner undergoes secondary transfer from the intermediate transfer belt to the recording medium. After passing between the backup roller 408 and the secondary transfer roller 413, the intermediate transfer belt 409 is surface-cleaned by either a cleaning blade 416 positioned near the driver roller 406 or a charge neutralizing device (not shown in the drawing), and is then reused in the next image forming process. Furthermore, a tray (a transfer target medium tray) 411 is provided at a predetermined position within the housing 400, and a transfer target medium 500 such as paper stored within this tray 411 is fed by feed rollers 412 so as to pass between the intermediate transfer belt 409 and the secondary transfer roller 413, and then between two mutually contacting fixing rollers 414, before being discharged from the housing 400.

An image forming method according to an exemplary embodiment of the present invention includes: forming an electrostatic latent image on the surface of a latent image holding member; developing the electrostatic latent image formed on the surface of the latent image holding member using a developer supported on a developer carrier, thereby forming a toner image; transferring the toner image formed on the surface of the latent image holding member to the surface of a transfer target; and heat fixing the toner image that has been transferred to the surface of the transfer target, wherein the developer contains at least a toner for developing an electrostatic latent image according to the present invention. The developer may be either a one-component system or a two-component system.

Each of the above steps can use conventional processes from known image forming methods.

An electrophotographic photoreceptor or a dielectric recording material may be used as the latent image holding member. In the case of an electrophotographic photoreceptor, the surface of the electrophotographic photoreceptor is charged uniformly using a corotron charger or a contact charger or the like, and is then exposed to form an electrostatic latent image (the latent image-forming step). Subsequently, toner particles are adhered to the electrostatic latent image by bringing the image either into contact with, or into close proximity to, a developing roller with a developer layer formed on the surface thereof, thereby forming a toner image on the electrophotographic photoreceptor (the developing step). The thus formed toner image is then transferred to the surface of a transfer target material such as a sheet of paper using a corotron charger or the like (the transfer step). The toner image that has been transferred to the surface of the transfer target is subsequently subjected to heat fixing using a fixing unit, thereby forming the final toner image.

During heat fixing by the above fixing unit, a release agent is usually supplied to the fixing member of the above fixing unit in order to prevent offset problems and the like.

There are no particular restrictions on the method used for supplying the release agent to the surface of the roller or belt that functions as the fixing member during heat fixing, and suitable methods include a pad system that uses a pad impregnated with the liquid release agent, a web system, a roller system, and a non-contact shower system (a spray system), although of these, a web system or roller system is preferred. These systems offer the advantages that the release agent can be supplied uniformly, and the quantity of release agent supplied can be readily controlled. If a shower system is used, then a separate blade or the like should be used to ensure that the release agent is supplied uniformly across the entire fixing member.

In the image forming apparatus of this exemplary embodiment, the contact time within the fixing unit, namely the contact time with the fixing member while positioned between the two fixing rollers 414 shown in FIG. 1, is at least 0.01 seconds but no longer than 0.1 seconds. If this contact time with the fixing member is less than 0.01 seconds, then the quantity of heat required for satisfactory fixing may not be able to be transferred, and satisfactory adhesion of the toner to the recording medium may be unattainable, whereas if the contact time with the fixing member exceeds 0.1 seconds, then the release agent and the crystalline polyester resin tend to exude out from the toner of the exemplary embodiment, this exuded crystalline polyester resin permeates into the recording medium, and when the resin subsequently crystallizes upon cooling, the adhesion to the recording medium deteriorates, increasing the possibility of a deterioration in the image folding resistance. The fixing member refers to a heated member such as a fixing roller that is brought into contact with the recording medium, and the contact time with the fixing member refers to the period of time for which the fixing member is in contact with the recording medium. For example, in the case of a fixing unit in which the fixing roller and the recording medium are brought into contact by passing the recording medium between the fixing roller and another roller that contacts the fixing roller, the contact time with the fixing member is defined as the width (the nip width) across which the fixing roller and the other roller that contacts the fixing roller make physical contact divided by the travel speed with which the recording medium passes between the rollers. In a specific example, if the nip width is 5 mm and the travel speed of the recording medium is 100 mm/s, then the contact time with the fixing member is $5/100=0.05$ seconds. The nip width is determined using the method described below. First, a full-sheet solid image is prepared on R-paper manufactured by Fuji Xerox Co., Ltd, using a DOCUCENTRE COLOR 400CP apparatus manufactured by Fuji Xerox Co., Ltd. If the 75 degree specular gloss of the full-sheet solid image, measured in accordance with JIS Z8741-1997, is 20% or lower, then a different copying machine or paper may be used. Subsequently, the solid image is re-inserted into the apparatus, and as the solid image sheet is being output, the power to the apparatus is cut as the sheet is passing through the fixing unit, and the apparatus is left to stand for 10 seconds. The solid image in contact with the fixing roller is then removed from the apparatus. By leaving the image to stand for 10 seconds in this manner, the gloss of the portion of the solid image in contact with the fixing roller changes, and the width of this portion with a changed gloss level is measured and used as the nip width. The size of the paper used is A4, and the nip width is the width measured in the central portion of that paper.

Examples of suitable transfer target materials (recording materials) to which the toner image can be transferred include the types of normal paper and OHP sheets and the like used in electrophotographic copying machines and printers and the like.

PREFERRED EMBODIMENT

A toner for developing an electrostatic latent image wherein the acid value of the crystalline polyester resin is within a range from 5 to 10 mgKOH/g, the acid value of the non-crystalline polyester resin is within a range from 10 to 15 mgKOH/g, the melting temperature of the crystalline polyester resin determined in accordance with ASTM D3418-8 is within a range from 65 to 75° C. and the weight average molecular weight (Mw) of the crystalline polyester resin is from 10,000 to 25,000, the glass transition temperature (Tg) of the non-crystalline polyester resin determined in accordance with ASTM D3418-8 is within a range from 55 to 65° C. and the weight average molecular weight (Mw) of the non-crystalline polyester is from 20,000 to 50,000, and the weight ratio between the crystalline polyester resin and the non-crystalline polyester resin is within a range from 5/95 to 40/60.

Furthermore, by suitably controlling the acid values and weight average molecular weights of the crystalline polyester resin and the non-crystalline polyester resin, as well as the melting temperature of the crystalline polyester resin and the glass transition temperature of the non-crystalline polyester resin, thereby ensuring a suitable co-solubility relationship between the crystalline polyester resin and the non-crystalline polyester resin, uneven distribution during toner manufacture can be suppressed, enabling an improvement in the hot storage properties of the toner.

EXAMPLES

As follows is a more detailed description of the present invention based on a series of examples, although the present invention is in no way limited by the examples presented below.

In the following examples, the various measurements are conducted using the methods described below.

—Method of Measuring Particle Size and Particle Size Distribution—

As follows is a description of the measurement of particle size (also referred to as particle diameter) and particle size distribution (also referred to as particle diameter distribution).

In those cases where the particle size to be measured is 2 μm or greater, measurement is conducted using a COULTER MULTISIZER-II (manufactured by Beckman Coulter, Inc.), using ISOTON-II (manufactured by Beckman Coulter, Inc.) as the electrolyte.

The measurement method involves adding from 0.5 to 50 mg of the measurement sample to a surfactant as the dispersant (2 ml of a 5% aqueous solution of a sodium alkylbenzenesulfonate is preferred), and then adding this sample to 100 ml of the above electrolyte.

The electrolyte containing the suspended sample is subjected to dispersion treatment for approximately one minute in an ultrasound disperser, and then using the aforementioned COULTER MULTISIZER-II, the particle size distribution is measured for particles from 2 to 60 μm using an aperture size of 100 μm, and the volume average particle size distribution and the number average particle size distribution are then determined. The number of particles measured is 50,000.

Furthermore, the toner particle size distribution is determined in the following manner. Namely, the previously measured particle size distribution is divided into particle size ranges (channels), and a volume cumulative distribution curve is drawn beginning at the smaller particle sizes. On this curve, the particle size at the point where the accumulated number of particles reaches 16% is defined as D16p, and the particle size at the point where the accumulated particle volume reaches 50% is defined as D50v. Similarly, the particle size at the point where the accumulated number of particles reaches 84% is defined as D84p.

In the present invention, the volume average particle size refers to D50v, and the number average particle size distribution index on the low particle size side GSDp-low is calculated using the formula shown below.

$$GSDp\text{-low}=\{(D84p)/(D16p)\}^{0.5}$$

In those cases where the particle size to be measured is less than 2 μm, measurement is conducted using a laser diffraction particle size distribution analyzer (LA-700, manufactured by Horiba, Ltd.). The measurement method involves adjusting the dispersion-state sample so that the solid fraction of the sample is approximately 2 g, and then adding ion-exchanged water to make the sample up to approximately 40 ml. This sample is then added to the cell in sufficient quantity to generate a suitable concentration, the sample is then left to stand for approximately 2 minutes until the concentration within the cell has substantially stabilized, and the measurement is then conducted. The volume average particle size for each of the obtained channels is accumulated beginning at the smaller volume average particle sizes, and the point where the accumulated value reaches 50% is defined as the volume average particle size.

In the case of the measurement of a powder of an external additive or the like, 2 g of the sample for measurement is added to a surfactant (50 ml of a 5% aqueous solution of a sodium alkylbenzenesulfonate is preferred), and the resulting mixture is dispersed for two minutes using an ultrasound dispersion device (1,000 Hz), thereby yielding a sample. This sample is then measured in the same manner as the dispersion described above.

—Method of Measuring Shape Factor SF1—

The shape factor SF1 of a toner is a shape factor SF that indicates the degree of unevenness on the surface of the toner particles, and is calculated using the formula shown below.

$$SF1=(ML^2/A)\times(\pi/4)\times 100$$

In this formula, ML represents the maximum length of a toner particle, and A represents the projected area of the toner particle. Measurement of the shape factor SF1 is conducted by first loading an optical microscope image of a toner scattered on a slide glass into an image analyzer via a video camera, subsequently calculating the SF value for at least 50 toner particles, and then determining the average value of these calculated shape factor values.

—Method of Measuring Molecular Weight and Molecular Weight Distribution for Toners and Resin Particles—

Measurements of the molecular weight distribution are conducted under the following conditions. Namely, the GPC is conducted using devices HLC-8120GPC and SC-8020 (manufactured by Tosoh Corporation), two columns (TSK-GEL, SUPER HM-H, manufactured by Tosoh Corporation, 6.0 mmID×15 cm), and using THF (tetrahydrofuran) as the eluent. Testing is conducted under conditions including a sample concentration of 0.5%, a flow rate of 0.6 ml/minute, a sample injection volume of 10 μl, and a measurement temperature of 40° C., using an IR detector. Furthermore, the calibration curve is prepared using 10 polystyrene TSK standards manufactured by Tosoh Corporation: A-500, F-1, F-10, F-80, F-380, A-2500, F-4, F-40, F-128 and F-700.

The melting temperature and glass transition temperature of the toner are determined using a DSC (differential scanning calorimetry) measurement method, and are determined from the subjective maximum peak, measured in accordance with ASTM D3418-8.

Measurement of the subjective maximum peak can be conducted using a DSC-7 manufactured by PerkinElmer Inc. In this device, temperature correction at the detection portion is conducted using the melting temperatures of indium and zinc, and correction of the heat quantity is conducted using the heat of fusion of indium. The sample is placed in an aluminum pan, and using an empty pan as a control, measurement is conducted at a rate of temperature increase of 10° C./minute.

—Method of Measuring Acid Value—

Approximately 1 g of the resin is weighed accurately and dissolved in 80 ml of tetrahydrofuran. Phenolphthalein is added as an indicator, and then a titration is performed using an ethanol solution containing 0.1N KOH, with the end point being determined as the point at which the color is retained for 30 seconds. The quantity used of the 0.1N KOH ethanol solution is then used to calculate the acid value (the number of mg of KOH required to neutralize the free fatty acid incorporated within 1 g of the resin, as defined in JIS K0070:92).

—Measurement of Endothermic Peaks Derived from Crystalline Resin and Release Agent within the Toner Using Differential Scanning Calorimetry—

Endothermic peaks and heat absorption quantities derived from the crystalline resin and release agent within the toner are measured by thermal analysis using a differential scanning calorimeter (DSC-60A, manufactured by Shimadzu Corporation) (hereafter also abbreviated as "DSC"). The measurement involves raising the temperature from room temperature to 150° C. at a rate of 10° C./minute in a first temperature raising step, holding the temperature at 150° C. for 5 minutes, subsequently using liquid nitrogen to cool the temperature to 0° C. at a rate of 10° C./minute, holding the temperature at 0° C. for 5 minutes, and then reheating the sample and raising the temperature from 0° C. to 150° C. at a rate of 10° C./minute in a second temperature raising step.

—Measurement of Image Folding Resistance—

Evaluation of the toner is conducted using the modified DOCUCENTRE COLOR 400CP apparatus shown in FIG. 1 (manufactured by Fuji Xerox Co., Ltd.), by setting the temperature of the fixing roller to 180° C., altering the output speed between 55 mm/s, 160 mm/s and 220 mm/s, outputting an image with a toner quantity of 15 mg/cm$^2$, folding the output solid image inwards for 30 seconds at 40 g/cm$^2$, opening the image back out, wiping the creased area of the image with a soft cloth, and then measuring the maximum width of image loss, which is subsequently recorded as the image folding resistance.

Toners that exhibit no image loss are ideal, but folding resistance values of approximately 0.5 mm present no particular problems. The results are shown in the following tables. Furthermore, an aforementioned output image is also placed in an electric oven at 50° C. for 72 hours, and subsequently removed from the oven and subjected to the same folding resistance evaluation as that described above. The results are shown in the tables.

Next is amore detailed description of the present invention based on a series of examples, although the present invention is in no way limited by the examples presented below. Toners of the present invention can be obtained using the method described below.

Namely, the crystalline resin particles, non-crystalline resin particles, colorant particle dispersion and release agent particle dispersion described below are first prepared. Subsequently, predetermined quantities of these materials are mixed together and an ionic neutralization is conducted by adding polyaluminum chloride to the mixture, thereby forming aggregates of the above particles. Prior to reaching the desired toner particle size, additional resin particles are added to achieve the desired toner particle size. Subsequently, an inorganic hydroxide is used to adjust the pH within the system from a slightly acidic state to an alkaline state, and heating is then conducted at a temperature higher than the subjective maximum endothermic peak temperature of the resin particles determined by differential thermal analysis, thereby fusing the toner particles and forming a toner suspension. Following completion of the reaction, the suspension is cooled rapidly, washed thoroughly, subjected to a solid-liquid separation, and then dried to yield the product toner.

As follows are descriptions of methods used for preparing the various materials, and examples of methods of preparing the aggregate particles.

[Synthesis of Resin Particles]

—Crystalline Polyester Resin Synthesis 1—

A heat-dried three-necked flask is charged with 120.0 parts by weight of 1,10-decanediol, 80.0 parts by weight of sodium dimethyl 5-sulfoisophthalate, 4 parts by weight of dimethylsulfoxide, and 0.02 parts by weight of dibutyltin oxide as a catalyst, a reduced pressure operation is used to replace the air inside the flask with an inert atmosphere of nitrogen gas, and the mixture is then stirred for 3 hours at 180° C. using a mechanical stirrer. The dimethylsulfoxide is then removed by distillation under reduced pressure, 23.0 parts by weight of dimethyl dodecanedioate is added under a stream of nitrogen, and the resulting mixture is stirred for a further 1 hour at 180° C.

Subsequently, the temperature is raised gradually to 220° C. under reduced pressure, and stirring is continued for a further 30 minutes. Once a viscous state is reached, the mixture is air-cooled to halt the reaction, thus completing synthesis of a crystalline polyester resin.

Measurement of the weight average molecular weight (Mw) of the thus obtained crystalline polyester resin (1) using a gel permeation chromatography measurement (against polystyrene standards) reveals a value of 20,000. Furthermore, measurement of the melting temperature (Tm) of the resin using a differential scanning calorimeter (DSC) in the manner described above reveals a sharp peak, with a peak top temperature of 75° C. The acid value of the resin determined by KOH titration is 10 mgKOH/g.

—Crystalline Polyester Resin Synthesis 2—

A heat-dried three-necked flask is charged with 124 parts by weight of ethylene glycol, 2 parts by weight of dimethylsulfoxide and 2 parts by weight of dibutyltin oxide, a reduced pressure operation is used to replace the air inside the flask with an inert atmosphere of nitrogen gas, and the mixture is then stirred for 3 hours at 120° C. using a mechanical stirrer. The dimethylsulfoxide is then removed by distillation under reduced pressure, 23.0 parts by weight of dimethyl dodecanedioate is added under a stream of nitrogen, and the resulting mixture is stirred for a further 3 hours at 200° C.

Subsequently, the temperature is raised gradually to 220° C. under reduced pressure, and stirring is continued for a further 30 minutes. Once a viscous state is reached, the mixture is air-cooled to halt the reaction, thus completing synthesis of a crystalline polyester resin. Measurement of the weight average molecular weight (Mw) of the thus obtained crystalline polyester resin using a gel permeation chromatography measurement (against polystyrene standards) reveals a value of 11,000. Furthermore, measurement of the melting temperature (Tm) of the crystalline polyester resin using the method described above reveals a value of 64° C. The acid value of the resin determined by KOH titration is 5 mgKOH/g.

—Crystalline Polyester Resin Synthesis 3—

A heat-dried three-necked flask is charged with 144 parts by weight of ethylene glycol, 178 parts by weight of sebacic acid, 2 parts by weight of dimethylsulfoxide and 2 parts by weight of dibutyltin oxide as a catalyst, a reduced pressure operation is used to replace the air inside the flask with an inert atmosphere of nitrogen gas, and the mixture is then stirred for 3 hours at 120° C. using a mechanical stirrer. The dimethylsulfoxide is then removed by distillation under reduced pressure, 23.0 parts by weight of dimethyl dodecanedioate is added under a stream of nitrogen, and the resulting mixture is stirred for a further 3 hours at 200° C.

Subsequently, the temperature is raised gradually to 220° C. under reduced pressure, and stirring is continued for a further 30 minutes. Once a viscous state is reached, the mixture is air-cooled to halt the reaction, thus completing synthesis of a crystalline polyester resin. Measurement of the weight average molecular weight (Mw) of the thus obtained crystalline polyester resin (3) using a gel permeation chromatography measurement (against polystyrene standards) reveals a value of 9,800.

Furthermore, measurement of the melting temperature (Tm) of the crystalline polyester resin (3) using a differential scanning calorimeter (DSC) in the manner described above reveals a sharp peak, with a peak top temperature of 62° C. The acid value of the resin determined by KOH titration is 3 mgKOH/g.

—Crystalline Polyester Resin Synthesis 4—

A heat-dried three-necked flask is charged with 90.0 parts by weight of 1,10-decanediol, 110 parts by weight of sodium dimethyl 5-sulfoisophthalate, 4 parts by weight of dimethylsulfoxide, and 0.02 parts by weight of dibutyltin oxide as a catalyst, a reduced pressure operation is used to replace the air inside the flask with an inert atmosphere of nitrogen gas, and the mixture is then stirred for 3 hours at 180° C. using a mechanical stirrer. The dimethylsulfoxide is then removed by distillation under reduced pressure, 23.0 parts by weight of dimethyl dodecanedioate is added under a stream of nitrogen, and the resulting mixture is stirred for a further 1 hour at 180° C.

Subsequently, the temperature is raised gradually to 220° C. under reduced pressure, and stirring is continued for a further 30 minutes. Once a viscous state is reached, the mixture is air-cooled to halt the reaction, thus completing synthesis of a crystalline polyester resin. Measurement of the weight average molecular weight (Mw) of the thus obtained crystalline polyester resin (4) using a gel permeation chromatography measurement (against polystyrene standards) reveals a value of 30,200. Furthermore, measurement of the melting temperature (Tm) of the crystalline polyester resin using a differential scanning calorimeter (DSC) in the manner described above reveals a sharp peak, with a peak top temperature of 79° C. The acid value of the resin determined by KOH titration is 15 mgKOH/g.

—Non-Crystalline Polyester Resin Synthesis 1—

A heat-dried three-necked flask is charged with:

112 parts by weight of dimethyl naphthalenedicarboxylate, 97 parts by weight of dimethyl terephthalate, 221 parts by weight of a 2-mol ethylene oxide adduct of bisphenol A, 80 parts by weight of ethylene glycol, and 0.07 parts by weight of tetrabutoxy titanate, and a transesterification reaction is then conducted by heating the mixture at 170 to 220° C. for a period of 180 minutes. Subsequently, the reaction is continued for 60 minutes at 220° C. while the system pressure is reduced to a level from 1 to 10 mmHg, thereby yielding a non-crystalline polyester resin (1). The glass transition temperature of this polyester resin is 65° C. Furthermore, the acid value of the resin determined by KOH titration is 10 mgKOH/g.

—Non-Crystalline Polyester Resin Synthesis 2—

A heat-dried three-necked flask is charged with:

87 parts by weight of dimethyl terephthalate, 97 parts by weight of dimethyl isophthalate, 158 parts by weight of a 2-mol ethylene oxide adduct of bisphenol A, 110 parts by weight of ethylene glycol, and 0.07 parts by weight of tetrabutoxy titanate, and a transesterification reaction is then conducted by heating the mixture at 170 to 220° C. for a period of 180 minutes. Subsequently, the reaction is continued for 60 minutes at 220° C. while the system pressure is reduced to a level from 1 to 10 mmHg, thereby yielding a non-crystalline polyester resin (2). The glass transition temperature of this polyester resin is 55° C. Furthermore, the acid value of the resin determined by KOH titration is 15 mgKOH/g.

—Non-Crystalline Polyester Resin Synthesis 3—

A heat-dried three-necked flask is charged with:

58 parts by weight of dimethyl terephthalate, 78 parts by weight of dimethyl isophthalate, 30 parts by weight of succinic anhydride, 158 parts by weight of a 2-mol ethylene oxide adduct of bisphenol A, 100 parts by weight of ethylene glycol, and 0.07 parts by weight of tetrabutoxy titanate, and a transesterification reaction is then conducted by heating the mixture at 170 to 220° C. for a period of 180 minutes. Subsequently, the reaction is continued for 60 minutes at 220° C. while the system pressure is reduced to a level from 1 to 10 mmHg, thereby yielding a non-crystalline polyester resin (3). The glass transition temperature of this polyester resin is 53° C. Furthermore, the acid value of the resin determined by KOH titration is 20 mgKOH/g.

—Non-Crystalline Polyester Resin Synthesis 4—

A heat-dried three-necked flask is charged with:

146 parts by weight of dimethyl naphthalenedicarboxylate, 78 parts by weight of dimethyl terephthalate, 221 parts by weight of a 2-mol ethylene oxide adduct of bisphenol A, 70 parts by weight of ethylene glycol, and 0.07 parts by weight of tetrabutoxy titanate, and a transesterification reaction is then conducted by heating the mixture at 170 to 220° C. for a period of 180 minutes. Subsequently, the reaction is continued for 60 minutes at 220° C. while the system pressure is reduced to a level from 1 to 10 mmHg, thereby yielding a non-crystalline polyester resin (4). The glass transition temperature of this polyester resin is 67° C. Furthermore, the acid value of the resin determined by KOH titration is 8 mgKOH/g.

—Preparation of Resin Particle Dispersion 1—

The resins obtained in the above syntheses of crystalline polyester resins and non-crystalline polyester resins are ground coarsely using a hammer mill, and subsequently used to prepare resin particle dispersions.

A 2 L separable flask fitted with an anchor impeller that imparts a stirring action, a reflux condenser, and a vacuum pump is charged with 50 parts by weight of ethyl acetate, 110 parts by weight of IPA is added, and the flask is then flushed with $N_2$ at a flow rate of 0.2 L/m to replace the air inside the system with $N_2$. Subsequently, an oil bath is used to raise the temperature inside the system to 60° C., while 50 parts by weight of the crystalline polyester resin (1) and 150 parts by weight of the non-crystalline polyester resin (1) are added gradually and dissolved under constant stirring. Subsequently, 20 parts by weight of 10% ammonia water is added to the system, and a metered pump is then used to introduce 460 parts by weight of ion-exchanged water at a rate of 9.6 g/minutes under constant stirring. Once the emulsification system has developed a milky white appearance and the stirring viscosity has fallen, the emulsification is deemed to be complete.

Subsequently, the pressure is reduced to 700 Torr, and stirring is continued for a further 40 minutes. 50 parts by weight of 60° C. pure water is then added to the system, and stirring under reduced pressure is continued for a further 20 minutes. The point where the reflux quantity reaches 210 parts by weight is deemed the end point, and heating is then halted and the flask is cooled to room temperature with continued stirring. The particle size of the resulting resin particles is measured using a laser diffraction/scattering particle size distribution analyzer (LA-920, manufactured by Horiba, Ltd.). The average particle size of the obtained emulsified resin particles is 282 nm.

—Preparation of Resin Particle Dispersion 2

With the exceptions of using 22.5 parts by weight of the crystalline polyester resin (2) and 177.5 parts by weight of the non-crystalline polyester resin (2), preparation is conducted in the same manner as the above resin particle preparation 1. The average particle size of the obtained resin particles is 86 nm.

—Preparation of Resin Particle Dispersion 3—

With the exceptions of using 95 parts by weight of the crystalline polyester resin (3) and 105 parts by weight of the non-crystalline polyester resin (3), preparation is conducted in the same manner as the above resin particle preparation 1. The average particle size of the obtained resin particles is 72 nm.

—Preparation of Resin Particle Dispersion 4

With the exceptions of using the crystalline polyester resin (4) and the non-crystalline polyester resin (4), preparation is conducted in the same manner as the above resin particle preparation 1. The average particle size of the obtained resin particles is 365 nm.

—Preparation of Cyan Colorant Dispersion—

50 parts be weight of a cyan pigment (copper phthalocyanine B15:3, manufactured by Dainichiseika Color & Chemicals Mfg. Co., Ltd.)

5 parts by weight of an ionic surfactant (NEOGEN RK, manufactured by Dai-ichi Kogyo Seiyaku Co., Ltd.)

195 parts by weight of ion-exchanged water

The above components are mixed together and dissolved, and then dispersed for 10 minutes using a homogenizer (ULTRA TURRAX, manufactured by IKA Works Inc.), yielding a colorant dispersion with a center particle size of 168 nm.

—Preparation of Yellow Colorant Dispersion—

50 parts be weight of a yellow pigment (C.I. Pigment Yellow 74, manufactured by Dainichiseika Color & Chemicals Mfg. Co., Ltd.)

5 parts by weight of an ionic surfactant (NEOGEN RK, manufactured by Dai-ichi Kogyo Seiyaku Co., Ltd.)

195 parts by weight of ion-exchanged water

The above components are mixed together and dissolved, and then dispersed for 10 minutes using a homogenizer (ULTRA TURRAX, manufactured by IKA Works Inc.), yielding a colorant dispersion with a center particle size of 168 nm.

—Preparation of Magenta Colorant Dispersion—

50 parts by weight of C.I. Pigment Red 122 (manufactured by Clariant Ltd.)

6 parts by weight of an ionic surfactant (NEOGEN RK, manufactured by Dai-ichi Kogyo Seiyaku Co., Ltd.)

200 parts by weight of ion-exchanged water

The above components are mixed together and dissolved, and then dispersed for 10 minutes using a homogenizer (ULTRA TURRAX, manufactured by IKA Works Inc.), yielding a magenta colorant dispersion with a center particle size of 185 nm and a solid fraction of 23.5% by weight.

—Preparation of Black Colorant Dispersion—

50 parts by weight of carbon black (REGAL 330, manufactured by Cabot Corporation) 6 parts by weight of an ionic surfactant (NEOGEN RK, manufactured by Dai-ichi Kogyo Seiyaku Co., Ltd.)

200 parts by weight of ion-exchanged water

The above components are mixed together and dissolved, and then dispersed for 10 minutes using a homogenizer (ULTRA TURRAX, manufactured by IKA Works Inc.), yielding a black colorant dispersion with a center particle size of 240 nm and a solid fraction of 24.0% by weight.

—Preparation of Release Agent Dispersion—

45 parts by weight of a paraffin wax FNP92 (melting temperature 91° C., manufactured by Nippon Seiro Co., Ltd.)

5 parts by weight of a cationic surfactant (NEOGEN RK, manufactured by Dai-ichi Kogyo Seiyaku Co., Ltd.)

200 parts by weight of ion-exchanged water

The above components are heated to 60° C., dispersed thoroughly using an ULTRA TURRAX T50 manufactured by IKA Works Inc., and subsequently subjected to further dispersion treatment using a pressure discharge GAULIN homogenizer, thereby yielding a wax dispersion with a center particle size of 170 nm and a solid fraction of 25% by weight.

Using the materials prepared above, toners are prepared using an aggregation fusion method.

Toner Production Example 1

80 parts by weight of the resin particle dispersion 1

60 parts by weight of the cyan colorant dispersion 60 parts by weight of the release agent dispersion 0.41 parts by weight of polyaluminum chloride The components listed above are mixed together and dispersed in a round-bottom stainless steel flask using an ULTRA TURRAX T50. 0.36 parts by weight of polyaluminum chloride is then added, and the dispersion operation using the ULTRA TURRAX is continued. The contents of the flask are then heated to 47° C. in an oil bath under constant stirring.

Subsequently, the pH inside the system is adjusted to a value of 8.0 using a 0.5 mol/L aqueous solution of sodium hydroxide, and the stainless steel flask is then sealed, the temperature is raised to 90° C. while stirring is continued using a magnetic stirrer, and the system is then held in this state for 3 hours.

Following completion of the reaction, the mixture is cooled, filtered, washed thoroughly with ion-exchanged water, and then subjected to a solid-liquid separation using Nutsche suction filtration. The resulting product is re-dispersed in 3 L of 40° C. ion-exchanged water, and is then washed by stirring at 300 rpm for 15 minutes.

This filtration and re-dispersion operation is repeated 5 times, and when the filtrate from the toner exhibits a pH of 7.01, an electrical conductivity of 9.8 μS/cm and a surface tension of 71.1 mN/m, a solid-liquid filtration is conducted by Nutsche suction filtration using a No. 5A filter paper. The toner is then subjected to continuous vacuum drying for 12 hours.

The toner volume average particle size D50 is 6.5 μm, and the particle size distribution index GSDv is 1.25. Furthermore, shape observation using a Luzex image analyzer reveals potato-shaped particles with a particle shape factor SF1 of 133.

Toner Production Example 2

With the exception of using the resin particle dispersion 2, preparation is conducted in the same manner as the toner production example 1.

Measurement of the particle size reveals a volume average particle size D50 of 6.1 μm and a particle size distribution index GSDv of 1.21. Furthermore, shape observation using a LUZEX image analyzer reveals potato-shaped particles with a particle shape factor SF1 of 128.

Toner Production Example 3

With the exception of using the resin particle dispersion 3, preparation is conducted in the same manner as the toner production example 1.

Measurement of the particle size reveals a volume average particle size D50 of 6.1 μm and a particle size distribution index GSDv of 1.21. Furthermore, shape observation using a LUZEX image analyzer reveals potato-shaped particles with a particle shape factor SF1 of 128.

Toner Production Example 4

With the exception of using the resin particle dispersion 4, preparation is conducted in the same manner as the toner production example 1.

Measurement of the particle size reveals a volume average particle size D50 of 5.8 μm and a particle size distribution index GSDv of 1.24. Furthermore, shape observation using a LUZEX image analyzer reveals potato-shaped particles with a particle shape factor SF1 of 128.

Toner Production Example 5

With the exception of replacing the cyan colorant dispersion with the magenta colorant dispersion, preparation is conducted in the same manner as the toner production example 1.

Measurement of the particle size reveals a volume average particle size D50 of 6.5 μm and a particle size distribution index GSDv of 1.25. Furthermore, shape observation using a LUZEX image analyzer reveals potato-shaped particles with a particle shape factor SF1 of 133.

Toner Production Example 6

With the exception of replacing the cyan colorant dispersion with the yellow colorant dispersion, preparation is conducted in the same manner as the toner production example 1.

Measurement of the particle size reveals a volume average particle size D50 of 6.6 μm and a particle size distribution index GSDv of 1.24. Furthermore, shape observation using a LUZEX image analyzer reveals potato-shaped particles with a particle shape factor SF1 of 134.

Toner Production Example 7

With the exceptions of replacing the cyan colorant dispersion with the black colorant dispersion, preparation is conducted in the same manner as the toner production example 1.

Measurement of the particle size reveals a volume average particle size D50 of 6.7 μm and a particle size distribution index GSDv of 1.24. Furthermore, shape observation using a LUZEX image analyzer reveals potato-shaped particles with a particle shape factor SF1 of 134.

—Preparation of External Additive Toners—

0.5 parts by weight of a hydrophobic silica (TS720, manufactured by Cabot Corporation) is added to 50 parts by weight of the prepared toner, and the resulting mixture is mixed for 5 minutes at 3,000 rpm using a HENSCHEL mixer.

—Preparation of Carrier 1—

85 parts by weight of 50 μm ferrite core particles manufactured by Powdertech Co., Ltd., and 15 parts by weight of 35 μm ferrite core particles are prepared. Mixing these materials together yields a particle size distribution of 1.45. This mixture is coated with a 1% resin coating of a styrene-methyl acrylate copolymer (manufactured by Soken Chemical & Engineering Co., Ltd., weight average molecular weight 81,000, copolymerization ratio 40:60) and then passed through a 105 μm sieve, yielding a carrier 1 with a particle size distribution of 1.42.

—Preparation of Carrier 2—

100 parts of the carrier 1 is placed on a sieve HC-60 (manufactured by Tanaka Sanjiro Co., Ltd., mesh size: 60 μm) and subjected to sonic sieving for 30 minutes, and the material that passes through the sieve is then placed on another sieve P-25 (manufactured by Tanaka Sanjiro Co., Ltd., mesh size: 25 μm) and subjected to similar sonic sieving for 30 minutes. The material retained on top of this second sieve is the carrier 2. The particle size distribution of the carrier 2 is 1.28.

—Preparation of Developers—

100 parts of a carrier is combined with sufficient toner to produce a toner concentration of 5%, and the resulting mixture is mixed for 5 minutes in a ball mill, yielding a developer.

Example 1

The structure and properties of the toner prepared in the toner production example 1 are evaluated. TEM observation of a toner cross section reveals the toner contains at least the non-crystalline polyester resin, the crystalline polyester resin, the release agent and the colorant, and a transmission electron microscope image of a ruthenium-stained cross section of the toner reveals the existence of structures in which the crystalline polyester resin contacts the release agent. If the cross-sectional area of these structures is labeled A, the cross-sectional area of lone portions of the release agent is labeled B, and the cross-sectional area of lone portions of the crystalline polyester resin is labeled C, then 100×A/(A+B+C)=70, 100×B/(A+B+C)=10, and 100×C/(A+B+C)=20.

Furthermore, in order to evaluate each toner, the developer using the carrier 2 is placed inside a modified DOCUCENTRE COLOR 400CP apparatus (manufactured by Fuji Xerox Co., Ltd.), the temperature of the fixing roller is set to 180° C., the output speed is altered between 55 mm/s, 160 mm/s and 220 mm/s, and 2 copies of an image with a toner quantity of 15 mg/cm$^2$ are output. Between 10 and 30 seconds following output, one copy of the solid image is folded inwards for 30 seconds at 40 g/cm$^2$, and the image is then opened back out, the creased area of the image is wiped with a soft cloth, and the maximum width of image loss is measured and recorded as the image folding resistance.

Toners that exhibit no image loss are ideal, but folding resistance values of approximately 0.5 mm present no particular problems. The results are shown in the following tables. Furthermore, the remaining output image is placed in an electric oven at 50° C. for 72 hours, and subsequently removed from the oven and subjected to the same folding resistance evaluation as that described above.

Example 2

The structure and properties of the toner prepared in the toner production example 2 are evaluated. 100×A/(A+B+C)=40, 100×B/(A+B+C)=30, and 100×C/(A+B+C)=30. Using the carrier 2, evaluations are conducted in the same manner as the example 1. The results are shown in the tables.

Example 3

The structure and properties of the toner prepared in the toner production example 5 are evaluated. 100×A/(A+B+C)=68, 100×B/(A+B+C)=11, and 100×C/(A+B+C)=21. Using the carrier 2, evaluations are conducted in the same manner as the example 1. The results are shown in the tables.

Example 4

The structure and properties of the toner prepared in the toner production example 6 are evaluated. 100×A/(A+B+C)=70, 100×B/(A+B+C)=10, and 100×C/(A+B+C)=20. Using the carrier 2, evaluations are conducted in the same manner as the example 1. The results are shown in the tables.

Example 5

The structure and properties of the toner prepared in the toner production example 7 are evaluated. 100×A/(A+B+C)=66, 100×B/(A+B+C)=12, and 100×C/(A+B+C)=22. Using the carrier 2, evaluations are conducted in the same manner as the example 1. The results are shown in the tables.

Example 6

Using the toner prepared in the toner production example 1 and the carrier 1, evaluations are conducted in the same manner as the example 1. The results are shown in the tables.

Comparative Example 1

The structure and properties of the toner prepared in the toner production example 3 are evaluated. 100×A/(A+B+C)=80, 100×B/(A+B+C)=5, and 100×C/(A+B+C)=15. Using the carrier 2, evaluations are conducted in the same manner as the example 1. The results are shown in the tables.

Comparative Example 2

The structure and properties of the toner prepared in the toner production example 4 are evaluated. 100×A/(A+B+C)=80, 100×B/(A+B+C)=5, and 100×C/(A+B+C)=15. Using the carrier 2, evaluations are conducted in the same manner as the example 1. The results are shown in the tables.

(Evaluation of Blocking)

Using the prepared developers and the modified DOCUCENTRE COLOR 400CP apparatus, manufactured by Fuji Xerox Co., Ltd, and shown in FIG. 1, image formation is conducted under conditions of 28° C. and 85% RH, by printing a print test chart with an image density of 1% onto color paper (J-paper) manufactured by Fuji Xerox Co., Ltd. After 3,000 copies have been printed, the solid portion of the image is inspected for the occurrence of white banding. Furthermore, the toner inside the developing unit is removed and inspected visually for blocking. The evaluation criteria are shown below.

A: No white banding, and almost no blocking of toner inside the developing unit.

B: No white banding, but some minor blocking of toner evident inside the developing unit.

C: Some minor white banding, and some blocking of toner evident inside the developing unit.

D: White banding is very noticeable, and blocking of toner evident inside the developing unit.

TABLE 1

| Crystalline polyester resin | | | |
|---|---|---|---|
| Synthesis Example | Mw | Tm (° C.) | Acid value (mgKOH/g) |
| 1 | 20,000 | 75 | 10 |
| 2 | 11,000 | 64 | 5 |
| 3 | 9,800 | 62 | 3 |
| 4 | 30,200 | 79 | 15 |

TABLE 2

| Non-crystalline polyester resin | | | |
|---|---|---|---|
| Synthesis Example | Mw | Tg (° C.) | Acid value (mgKOH/g) |
| 1 | 12,000 | 65 | 10 |
| 2 | 15,000 | 55 | 15 |
| 3 | 16,000 | 53 | 20 |
| 4 | 11,000 | 67 | 8 |

TABLE 3

| | Toner | Crystalline PE resin synthesis example | Non-crystalline PE resin synthesis example | Resin particle dispersion | D50 | GSD | SF1 | Carrier | Pigment |
|---|---|---|---|---|---|---|---|---|---|
| Example 1 | 1 | 1 | 1 | 1 | 6.5 | 1.25 | 133 | 2 | C |
| Example 2 | 2 | 2 | 2 | 2 | 6.1 | 1.21 | 128 | 2 | C |
| Example 3 | 5 | 1 | 1 | 1 | 6.5 | 1.25 | 133 | 2 | M |
| Example 4 | 6 | 1 | 1 | 1 | 6.6 | 1.24 | 134 | 2 | Y |
| Example 5 | 7 | 1 | 1 | 1 | 6.7 | 1.24 | 134 | 2 | K |
| Example 6 | 1 | 1 | 1 | 1 | 6.5 | 1.25 | 133 | 1 | C |
| Comparative example 1 | 3 | 3 | 3 | 3 | 6.1 | 1.21 | 128 | 2 | C |
| Comparative example 2 | 4 | 4 | 4 | 4 | 5.8 | 1.24 | 128 | 2 | C |

TABLE 4

| | 100 × A/ (A + B + C) | 100 × B/ (A + B + C) | 100 × C/ (A + B + C) | 55 mm/s | 160 mm/s | 220 mm/s | 55 mm/s after storage | 160 mm/s after storage | 220 mm/s after storage | Blocking |
|---|---|---|---|---|---|---|---|---|---|---|
| Example 1 | 70 | 10 | 20 | 0 mm | 0 mm | 0.1 mm | 0 mm | 0 mm | 0.1 mm | A |
| Example 2 | 40 | 30 | 30 | 0.1 mm | 0.1 mm | 0.2 mm | 0.1 mm | 0.2 mm | 0.4 mm | B |
| Example 3 | 68 | 11 | 21 | 0 mm | 0 mm | 0.1 mm | 0 mm | 0 mm | 0.1 mm | A |
| Example 4 | 70 | 10 | 20 | 0 mm | 0 mm | 0.1 mm | 0 mm | 0 mm | 0.1 mm | A |
| Example 5 | 66 | 12 | 22 | 0 mm | 0 mm | 0.1 mm | 0 mm | 0 mm | 0.1 mm | A |
| Example 6 | 70 | 10 | 20 | 0 mm | 0 mm | 0.1 mm | 0 mm | 0 mm | 0.1 mm | C |
| Comparative example 1 | 80 | 5 | 15 | 0.1 mm | 0.1 mm | 0.7 mm | 0.3 mm | 0.3 mm | 0.9 mm | A |
| Comparative example 2 | 80 | 5 | 15 | 0.1 mm | 0.1 mm | 0.7 mm | 0.3 mm | 0.3 mm | 0.9 mm | A |

The results of the examples and the comparative examples are summarized in Table 1 through Table 4. As is evident in Tables 3 and 4, by using the toners of the examples 1 through 6, the folding resistance of the image following storage can be retained at almost the same level as the initial image folding resistance.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic latent image, comprising a crystalline polyester resin, a non-crystalline polyester resin and a release agent, wherein:

an acid value of the crystalline polyester resin is within a range from 5 to 10 mgKOH/g;

an acid value of the non-crystalline polyester resin is within a range from 10 to 15 mgKOH/g;

a melting temperature of the crystalline polyester resin determined in accordance with ASTM D3418-8 is within a range from 50 to 120° C.;

a weight average molecular weight (Mw) of the crystalline polyester resin is within a range from 10,000 to 25,000;

a glass transition temperature (Tg) of the non-crystalline polyester resin determined in accordance with ASTM D3418-8 is 50° C. or higher;

a weight average molecular weight (Mw) of the non-crystalline polyester resin is within a range from 20,000 to 50,000;

a weight ratio between the crystalline polyester resin and the non-crystalline polyester resin is within a range from 5/95 to 40/60; and structures in which the crystalline polyester resin contacts the release agent exist in a ruthenium-stained cross section of the toner, and if a cross-sectional area of the structures is labeled A, a cross-sectional area of lone portions of the release agent is labeled B, and a cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$.

2. The toner for developing an electrostatic latent image according to claim 1, wherein a softening temperature of the non-crystalline polyester resin is within a range from 60 to 90° C.

3. The toner for developing an electrostatic latent image according to claim 1, wherein a quantity of the release agent relative to a total weight of the toner is within a range from 0.5 to 50% by weight.

4. The toner for developing an electrostatic latent image according to claim 1, wherein a volume average particle size distribution index GSDv of the toner is no greater than 1.30.

5. The toner for developing an electrostatic latent image according to claim 1, wherein a toner shape factor SF1 satisfies $110 \leqq SF1 \leqq 140$.

6. A method of manufacturing a toner for developing an electrostatic latent image, the method comprising:

adding a neutralizing agent and a water-based medium to a resin solution prepared by dissolving a non-crystalline polyester resin and a crystalline polyester resin in an organic solvent, thereby causing a phase inversion and generating an alkaline material;

subsequently forming O/W emulsified resin particles; and aggregating and fusing a resin particle dispersion obtained by removing the organic solvent from the emulsified resin particles and a release agent particle dispersion to obtain a toner that comprises the crystalline polyester resin, the non-crystalline polyester resin and the release agent, wherein:

an acid value of the crystalline polyester resin is within a range from 5 to 10 mgKOH/g;

an acid value of the non-crystalline polyester resin is within a range from 10 to 15 mgKOH/g;

a melting temperature of the crystalline polyester resin determined in accordance with ASTM D3418-8 is within a range from 50 to 120° C.;

a weight average molecular weight (Mw) of the crystalline polyester resin is within a range from 10,000 to 25,000;

a glass transition temperature (Tg) of the non-crystalline polyester resin determined in accordance with ASTM D3418-8 is 50° C. or higher;

a weight average molecular weight (Mw) of the non-crystalline polyester resin is within a range from 20,000 to 50,000;

a weight ratio between the crystalline polyester resin and the non-crystalline polyester resin is within a range from 5/95 to 40/60; and structures in which the crystalline polyester resin contacts the release agent exist in a ruthenium-stained cross section of the toner, and if a cross-sectional area of these structures is labeled A, a cross-sectional area of lone portions of the release agent is labeled B, and a cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$.

7. An electrostatic latent image developer, comprising a carrier with a particle size distribution of 1.3 or lower, and the toner for developing an electrostatic latent image according to claim 1.

8. A toner cartridge comprising a toner for developing an electrostatic latent image, the toner comprising a crystalline polyester resin, a non-crystalline polyester resin and a release agent, wherein:

an acid value of the crystalline polyester resin is within a range from 5 to 10 mgKOH/g;

an acid value of the non-crystalline polyester resin is within a range from 10 to 15 mgKOH/g;

a melting temperature of the crystalline polyester resin determined in accordance with ASTM D3418-8 is within a range from 50 to 120° C.;

a weight average molecular weight (Mw) of the crystalline polyester resin is within a range from 10,000 to 25,000;

a glass transition temperature (Tg) of the non-crystalline polyester resin determined in accordance with ASTM D3418-8 is 50° C. or higher;

a weight average molecular weight (Mw) of the non-crystalline polyester resin is within a range from 20,000 to 50,000;

a weight ratio between the crystalline polyester resin and the non-crystalline polyester resin is within a range from 5/95 to 40/60; and structures in which the crystalline polyester resin contacts the release agent exist in a ruthenium-stained cross section of the toner, and if a cross-sectional area of these structures is labeled A, a cross-sectional area of lone portions of the release agent is labeled B, and a cross-sectional area of lone portions of the crystalline polyester resin is labeled C, then $40 \leqq 100 \times A/(A+B+C) \leqq 70$, $10 \leqq 100 \times B/(A+B+C) \leqq 30$, and $20 \leqq 100 \times C/(A+B+C) \leqq 30$.

9. A removable cartridge, comprising a latent image forming unit that forms a latent image on a latent image holding member, a developing unit that develops the latent image using an electrostatic latent image developer, and a transfer unit that transfers the developed image to a transfer target, wherein the electrostatic latent image developer comprises the toner for developing an electrostatic latent image according to claim 1.

10. An image forming apparatus, comprising a latent image forming unit that forms a latent image on a latent image holding member, a developing unit that develops the latent image using an electrostatic latent image developer, a transfer unit that transfers the developed image to a transfer target, and a fixing unit that heat fixes the image on the transfer target, wherein the electrostatic latent image developer comprises the toner for developing an electrostatic latent image according to claim 1, and a contact time between an image and a fixing member within the fixing unit is at least 0.01 seconds but no longer than 0.1 seconds.

* * * * *